US010388501B1

(12) United States Patent
Liu et al.

(10) Patent No.: US 10,388,501 B1
(45) Date of Patent: Aug. 20, 2019

(54) ION TRANSFER DEVICE FOR MASS SPECTROMETRY WITH SELECTABLE BORES

(71) Applicant: Agilent Technologies, Inc., Santa Clara, CA (US)

(72) Inventors: Maozi Liu, Fremont, CA (US); Nigel P. Gore, San Jose, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 15/959,884

(22) Filed: Apr. 23, 2018

(51) Int. Cl.
*H01J 49/04* (2006.01)
*H01J 49/06* (2006.01)
*H01J 49/24* (2006.01)

(52) U.S. Cl.
CPC ..... *H01J 49/0404* (2013.01); *H01J 49/062* (2013.01); *H01J 49/24* (2013.01)

(58) Field of Classification Search
CPC ..... H01J 49/0404; H01J 49/062; H01J 49/24
USPC ..... 250/281, 282, 286, 288
See application file for complete search history.

(56) References Cited

U.S. PATENT DOCUMENTS 5,736,740 A 4/1998 Franzen
5,756,995 A 5/1998 Maswadeh et al.
6,380,538 B1 4/2002 Bajic
6,455,846 B1 9/2002 Prior et al.
6,486,469 B1 11/2002 Fischer et al.
6,667,474 B1 12/2003 Abramson et al.
6,777,672 B1 8/2004 Park
7,470,899 B2 12/2008 Atherton et al.
7,838,826 B1 11/2010 Park
9,048,079 B2 6/2015 Krutchinsky et al.
2005/0079137 A1 4/2005 Blondino et al.
2006/0108539 A1 5/2006 Franzen
2008/0142698 A1 6/2008 Atherton et al.
2009/0212210 A1 8/2009 Finlay et al.
2010/0276584 A1 11/2010 Splendore et al.
2018/0068840 A1 3/2018 Newton

FOREIGN PATENT DOCUMENTS

EP 1364387 A2 11/2003

*Primary Examiner* — Nicole M Ippolito
*Assistant Examiner* — Hanway Chang

(57) ABSTRACT

An ion transfer device for transferring ions from a first chamber to a second, reduced-pressure chamber includes a tube and a bore selector. The tube includes a plurality of tube bores. The bore selector is positioned at an inlet end of the tube and includes an inlet port. The tube is movable relative to the bore selector, and/or the bore selector is movable relative to the tube, to align the inlet port with a selected one of the tube bores while blocking the other tube bores. Alignment of the inlet port with the selected tube bore defines an ion transfer path from the first chamber, through the selected tube bore, and to the second chamber. The ion transfer device may be utilized, for example, in an atmospheric-pressure interface of a mass spectrometer.

20 Claims, 9 Drawing Sheets

ION TRANSFER DEVICE FOR MASS SPECTROMETRY WITH SELECTABLE BORES

TECHNICAL FIELD

The present invention relates generally to an ion transfer device, such as may be utilized to transfer ions from an atmospheric-pressure ion source into a mass spectrometer.

BACKGROUND

In the process of analyzing a sample by mass spectrometry (MS), an MS system first ionizes the sample to create analyte ions. The MS system then transfers the ions into a mass analyzer, and the mass analyzer resolves the ions on the basis of the ions' differing mass-to-charge (m/z) ratios. An ion detector measures the abundance of the ions at each m/z ratio detected. The MS system then processes signals outputted by the ion detector to generate mass (m/z) spectra that provide quantitative and qualitative information regarding the components of the sample (e.g., compounds, isomers, elements, etc.).

The mass analyzer operates in a controlled high-vacuum environment, for example at $10^{-5}$ to $10^{-9}$ Torr. In some MS systems, the ion source (where ionization of the sample is performed) also operates at a vacuum pressure. In other MS systems, such as when coupled to a liquid chromatography (LC) instrument (an LC-MS system), the ion source operates at or around atmospheric pressure. An MS system utilizing an atmospheric pressure ionization (API) source requires an interface between the API source and the evacuated regions of the MS system in which the mass analyzer and other devices are located. The interface needs to effectively isolate the atmospheric-pressure region where the ions are created (the API source) from the evacuated regions where the ions are processed and measured. At the same time, the interface needs to provide a way to efficiently transport the ions from the API source into the evacuated regions after the ions are created.

A capillary (i.e., a small-bore tube) is often utilized to transfer the ions from the API source into the first vacuum region of the MS system. The capillary has a small inside bore, the diameter of which may range from a fraction of a millimeter (mm) to a few millimeters. The capillary extends through the boundary between the API source and the first vacuum region, whereby the capillary's entrance is exposed to the ionization region of the API source and the capillary's exit is exposed to the first vacuum region. Ions and gas in the API source are drawn into the capillary's entrance, transported through the capillary's bore, and emitted from the capillary's exit into the first vacuum region. Ion optics guide the ions further into the MS system and ultimately to the mass analyzer. The capillary may be metal. Alternatively, the capillary tube may be glass with an electrically resistive property (coating or bulk resistance) to allow the capillary's entrance to be placed at a relatively high voltage level while the capillary's exit is maintained at a relatively low voltage level. In this case, the ions are effectively transported through the capillary's bore because the gas drag forces on the ions in the capillary greatly exceed the ion mobility (electric) forces on the ions in the presence of the internal electric field in the capillary.

Some ion transfer devices include multiple capillary bores that are fixed in position and parallel to each other. The multiple capillary bores may be located in a front section of an ion transfer device and provide multiple inlets that receive ions from the ion source, after which the multiple capillary bores transition to a single bore for the rest of the length of the ion transfer device. Alternatively, the multiple capillary bores may extend along the entire length of the ion transfer device and also provide multiple outlets from which ions are discharged into the first vacuum region of the MS system. Conventionally, the multiple capillary bores are utilized to simultaneously provide multiple, parallel paths for ions to travel through the capillary into the first vacuum stage. This has been done to increase the number of ions transported through the capillary or the amount of heat transferred into the capillary (e.g., to enhance evaporation and desolvation).

In an ideal situation, all (100% of) ions received by the ion transfer device would be transported to the MS inlet. Unfortunately, due to the small diameter of the capillary bore(s), the ions experience many collisions with the inside wall(s) of the bore(s) during the entire time the ions travel through the ion transfer device. The ion-wall collisions cause a large amount of ion losses inside the capillary. Moreover, some ions are lost at the entrance of the capillary due to electrostatic charging of the capillary. Many efforts are aimed at reducing the ion losses. One approach is to replace a glass (e.g., fused quartz) capillary with a capillary having an inside wall that is conductive with a high electrical resistance. An example of this approach is described in U.S. Pat. No. 5,736,740, the entire contents of which are incorporated herein by reference. This approach reduces the problem of the glass wall becoming charged. The approach may improve ion transport as much as 100-fold in comparison to use of a glass capillary, and also may enable faster polarity switching in applications where the MS system is switched between detecting positive ions and negative ions. Another approach is to provide an ion inlet section specially configured to reduce ion losses at the entrance of the ion transfer device, and which in some cases may be removable from rest of the ion transfer device for cleaning or replacement. This latter approach is described in U.S. Patent Application No. US 2018/0068840, the entire contents of which are incorporated herein by reference. Despite such approaches, a need remains for continued improvements in minimizing ion losses associated with ion transfer devices.

In addition, a capillary's ability to transport ions degrades over time due to chemical deposition on the inside wall and degradation of the coating on the inside wall. Consequently, users of MS systems are forced to clean or replace the capillary frequently to maintain a consistent ion signal response and stability in the MS system. Each cleaning or replacement of the capillary requires shutting down the MS system, cooling down the capillary, and in many cases bringing the MS system down to ambient pressure. The cleaning or replacement of the capillary may require the MS system to be out of operation for several days, severely limiting productivity. One approach to addressing this problem is to provide the ion transfer device with a removable inlet section. Such configuration allows the inlet section to be removed without having to break the vacuum in the MS system, as described in above-referenced U.S. Patent Application No. US 2018/0068840. Another approach is to provide a mechanical valve in the ion path that allows the capillary to be removed without compromising the vacuum, as described in U.S. Pat. No. 5,756,995, the entire contents of which are incorporated herein by reference. However, this latter approach may raise concerns about reliability and cost.

In view of the foregoing, a need remains for improved ion transfer devices.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion transfer device for transferring ions from a first chamber to a second chamber includes: a tube comprising an inlet end, an outlet end, a body elongated along a device axis from the inlet end to the outlet end, and a plurality of tube bores extending through the body from the inlet end to the outlet end, the tube bores being spaced from each other wherein the tube bores comprise respective bore inlets at the inlet end and respective bore outlets at the outlet end; and a bore selector positioned at the inlet end and comprising an inlet port, wherein at least one of the tube or the bore selector is movable to align the inlet port with the bore inlet of a selected tube bore of the plurality of tube bores while blocking at least one of the bore inlets of the other tube bores, and alignment of the inlet port with the bore inlet of the selected tube bore defines an ion transfer path through the inlet port and the selected tube bore.

According to another embodiment, an ion transfer system includes: an ion transfer device according to any of the embodiments disclosed herein; a first chamber; a second chamber configured to be evacuated down to a pressure lower than a pressure of the first chamber; and a wall separating the first chamber and the second chamber, the wall having a thickness and comprising an opening extending through the thickness, wherein the ion transfer device is positioned at the wall, at least one of the tube or both the tube and the bore selector extend into the opening, the inlet port communicates with the first chamber, and the bore outlets communicate with the second chamber.

According to another embodiment, a mass spectrometry (MS) system includes: an ion transfer system according to any of the embodiments disclosed herein; an atmospheric-pressure ionization device configured for producing ions in the first chamber; a vacuum housing enclosing the second chamber; and a mass analyzer disposed in the vacuum housing.

According to another embodiment, a method for transferring ions includes: creating a pressure differential between a first chamber and a second chamber such that the second chamber has a pressure less than a pressure of the first chamber, wherein: the first chamber and the second chamber are separated by a wall; and an ion transfer device extends through the wall and comprises a tube, the tube comprising a plurality of tube bores, the tube bores comprising respective bore inlets and bore outlets; placing a selected tube bore of the plurality of tube bores in communication with the first chamber while preventing communication between at least one of the other tube bores and the first chamber; producing ions in the first chamber; and drawing the ions into the selected tube bore, and transporting the ions through the selected tube bore and into the second chamber.

According to another embodiment, a method for transferring ions includes: creating a pressure differential between a first chamber and a second chamber such that the second chamber has a pressure less than a pressure of the first chamber, wherein the first chamber and the second chamber are separated by a wall, and the ion transfer device of claim 1 extends through the wall; producing ions in the first chamber; drawing the ions into the bore inlet of the selected tube bore while the bore inlet is aligned with the inlet port; transporting the ions through the selected tube bore; and emitting the ions from the bore outlet of the selected tube bore and into the second chamber.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

As used herein, the term "atmospheric pressure" is not limited to exactly 760 Torr, or one atmosphere (1 atm), but instead generally encompasses a range around 760 Torr (e.g., 100 to 900 Torr).

As used herein, the term "vacuum" or "vacuum pressure" generally refers to a pressure that is at least an order of magnitude less than atmospheric pressure. For example, vacuum pressure may encompass sub-atmospheric pressures down to $10^{-9}$ Torr or lower.

As appreciated by persons skilled in the art, different types of vacuum pumps may be utilized to bring an enclosed space, or vacuum chamber, down to different ranges of low pressure. For example, a "roughing" pump (or "backing" pump) may be utilized to pump a vacuum chamber down to a "rough" vacuum level of, for example, down to about $10^{-3}$ Torr. Roughing pumps typically have a predominantly mechanical design, examples of which include, but are not limited to, scroll pumps, rotary vane pumps, diaphragm pumps, Roots blower (positive displacement lobe) pumps, etc. High-vacuum pumps are utilized to achieve higher levels of vacuum (lower pressures), for example down to $10^{-9}$ Torr or lower. Examples of high-vacuum pumps include, but are not limited to, diffusion pumps, turbomolecular pumps and sputter-ion pumps. A roughing pump may be utilized in conjunction with a high-vacuum pump as a first stage of vacuum pump-down and/or to isolate a high-vacuum pump from rough-vacuum or higher-pressure environments.

Figure 1:
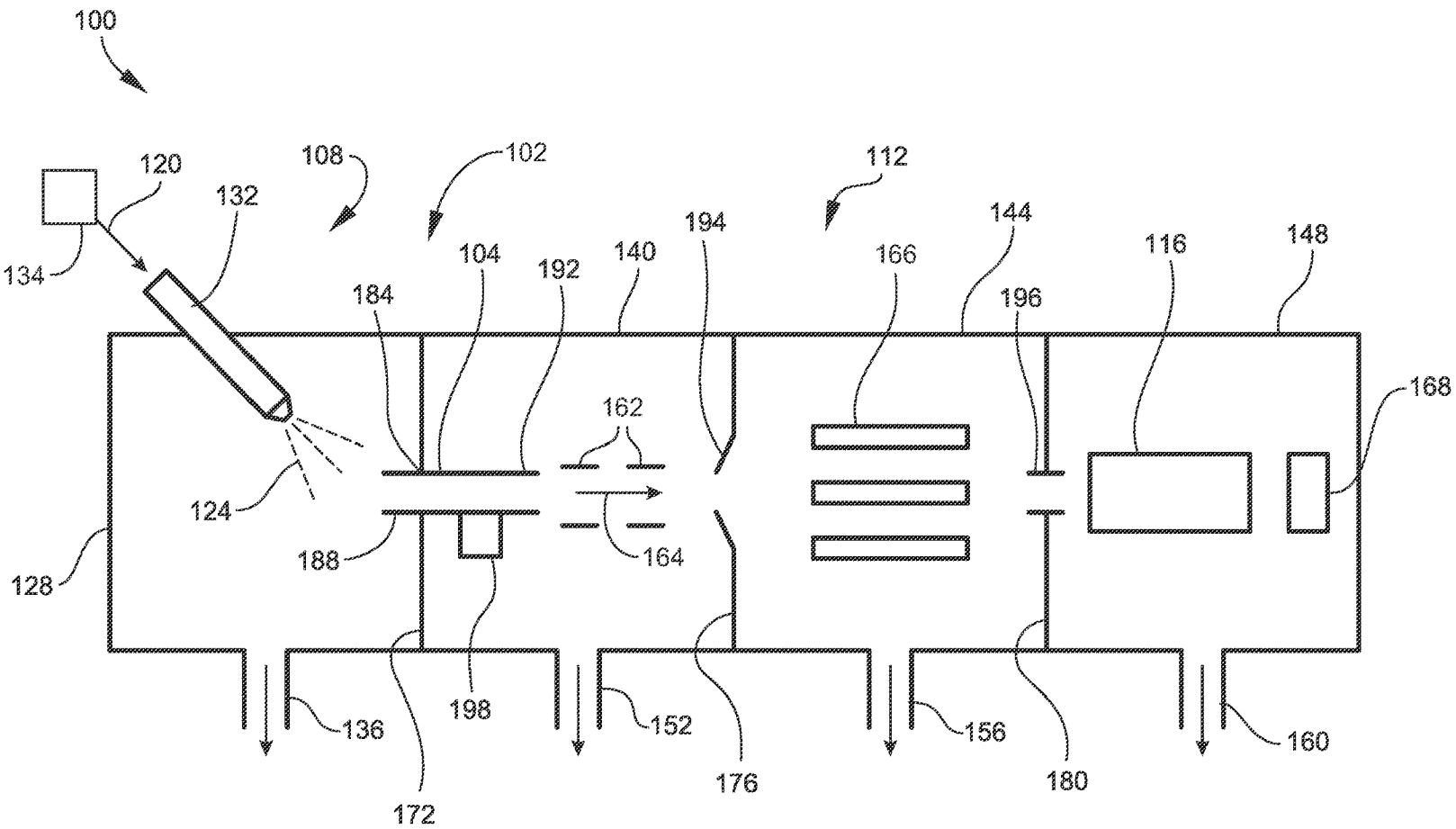
FIG. 1 is a schematic view of an example of an ion transfer system and associated mass spectrometry (MS) system in which an ion transfer device as presently disclosed herein may be provided according to an embodiment.

FIG. 1 is a schematic view of an example of a mass spectrometry (MS) system 100 in which an ion transfer device 104 as presently disclosed herein may be provided according to an embodiment. An MS system is but one non-exclusive example of an operating environment for the ion transfer device 104. More generally, the ion transfer device 104 may be utilized in any system in which ions are transferred from a region held at a relatively high pressure (e.g., atmospheric pressure) to another region held at a relatively lower pressure (e.g., sub-atmospheric or vacuum pressure). Different types of MS systems, their operating principles, and their components are generally known to persons skilled in the art. Therefore, the example of the MS system 100 illustrated in FIG. 1 is described herein only briefly to provide a non-limiting context for the presently disclosed ion transfer device 104.

In the illustrated example, the MS system 100 includes an atmospheric-pressure ionization (API) source (or ion source) 108 interfaced with a vacuum housing 112 in which a mass analyzer 116 and other ion processing components are located. Accordingly, the API source 108 is configured to ionize a sample 120 generally at atmospheric pressure, whereas the mass analyzer 116 is required to operate at high vacuum (very low pressure) in the usual manner. The ion transfer device 104 provides an ion transfer path for ions (and some neutral gas molecules or atoms) 124 to pass from the API source 108 into the vacuum housing 112, as described further below.

The API source 108 includes a first chamber 128, which in the present embodiment is an ionization chamber in which ions 124 are produced from the sample 120. The API source 108 also includes an atmospheric-pressure (AP) ionization device 132, which may be any device capable of ionizing a sample 120 at atmospheric pressure. Examples of AP ionization devices include, but are not limited to, spray-type devices (electrospray ionization (ESI) devices, thermospray ionization devices, sonic spray ionization devices, etc.), atmospheric-pressure chemical ionization (APCI) devices, atmospheric-pressure photoionization (APPI) devices, atmospheric-pressure laser desorption ionization (AP-LDI) devices, atmospheric-pressure matrix-assisted laser desorption ionization (AP-MALDI) devices, other ambient-pressure ionization devices (e.g., desorption electrospray ionization or DESI devices, direct analysis in real time or DART ionization devices, etc.), etc. Thus, depending on the embodiment, the ions 124 schematically depicted in FIG. 1 may be representative of an effluent from the ionization device 132 that includes, in addition to the ions 124, droplets containing analytes and non-analytical sample matrix materials that may be evaporated to produce more ions, and gas molecules or atoms utilized to nebulize the sample 120 and/or carry the sample 120 to the ionization device 132.

Depending on the type of ionization device 132 utilized, the sample 120 may be initially provided in the form of a fluid or a solid. For example, the sample 120 may be flowed to or into the ionization device 132 from a sample source 134. In some embodiments, the sample source 134 may be the output of a liquid chromatography (LC) instrument, capillary electrophoretic-based chromatography instrument, or other type of analytical separation instrument, as appreciated by persons skilled in the art. As another example, the sample 120 may be provided on a solid target surface (another type of sample source 134) and desorbed from the surface by the ionization device 132 (e.g., by using a flow of electrospray or a laser beam). The API source 108 may further include an exhaust port 136 through which gases and vapors may be removed from the first chamber 128 during the ionization process.

The vacuum housing 112 includes one or more vacuum chambers as necessary for pumping the MS system 100 down to the very low pressure (high vacuum) required for operating the mass analyzer 116, and for containing intermediate devices utilized for performing operations on the ions 124 prior to final mass analysis by the mass analyzer 116. In the illustrated example, the vacuum housing 112 includes a second vacuum chamber 140, a third vacuum chamber 144, and a fourth vacuum chamber 148, with the understanding that less or more vacuum chambers may be provided depending on the embodiment. The vacuum chambers 140, 144, and 148 include respective vacuum ports 152, 156, and 160 communicating with a vacuum system (schematically represented by downward arrows), which is configured for maintaining a specific level of vacuum in each of the vacuum chambers 140, 144, and 148 by removing gases at respective, controlled flow rates. Typically, the vacuum chambers 140, 144, and 148 are held (maintained by the vacuum system) at successively lower pressures, with the final (third) vacuum chamber 144 enclosing the mass analyzer 116 being held at the lowest pressure (highest vacuum) obtained by the MS system 100.

In the illustrated example, ion optics 162 are disposed in the second vacuum chamber (or interface chamber) 140, or alternatively may be disposed in a chamber (not shown) separate from the second vacuum chamber 140. Generally, the ion optics 162 may be one or more ion optics components (e.g., ion lenses) configured to focus ions exiting the ion transfer device 104 as a beam of ions 164 for further efficient transport into the evacuated regions of the MS system 100. For this purpose, (typically electrostatic) electrical potential(s) may be applied to the ion optics 162, as appreciated by persons skilled in the art. Also in the illustrated example, an ion guide 166 is disposed in the third chamber 144. The ion guide 166 may be of any type such as, for example, a linear multipole ion guide, an ion funnel, a collision cell, a mass filter, etc., or a combination of two or more such devices, as appreciated by persons skilled in the art. FIG. 1 illustrates a linear multipole ion guide by example, which includes a set of rod electrodes elongated along (and typically, but not always, parallel with) the central ion optical axis. Typically, the linear multipole ion guide has a quadrupole configuration (four rod electrodes), a hexapole configuration (six rod electrodes), or an octopole configuration (eight rod electrodes). For simplicity, only three rod electrodes are shown in FIG. 1.

The mass analyzer 116 and an ion detector 168 are disposed in the fourth chamber 148. The mass analyzer 116 may be of any type such as, for example, a quadrupole mass analyzer, a time-of-flight (TOF) analyzer, an ion cyclotron resonance (ICR) cell, a magnetic sector instrument and/or an electric sector instrument, an electrostatic ion trap, etc. The ion detector 168 may be of any type such as, for example, an electron multiplier, a multi-channel detector, a photomultiplier, a Faraday cup, etc.

Many other types of ion optics may be included in the chambers 128, 140, 144, and 148, as needed for the intended use and operation of the MS system 100, as appreciated by persons skilled in the art.

Adjacent chambers 128, 140, 144, and 148 of the MS system 100 may be separated by respective partitions or walls 172, 176, and 180. The ion transfer device 104 may extend into or through an opening 184 formed through the thickness of the wall 172 that separates the first (ionization) chamber 128 and the second (interface) chamber 140. By this configuration, an inlet end 188 of the ion transfer device 104 communicates with the first chamber 128, and an outlet end 192 of the ion transfer device 104 communicates with the second chamber 140. Thus, the inlet end 188 faces and may be disposed in the first chamber 128, and the outlet end 192 faces and may be disposed in the second chamber 140. In addition to providing an ion transfer path, the ion transfer device 104 is configured to serve as a gas conductance barrier that limits the flow of gas through the ion transfer device 104 and effectively maintains a pressure differential between the atmospheric-pressure first chamber 128 and the sub-atmospheric-pressure second chamber 140. The ion transfer device 104 may be mounted to the wall 172 in a fluid-tight manner, whereby the interior passage of the ion transfer device 104 provides the sole path for ions to travel from the API source 108 into the vacuum housing 112, and conductance of gas through the annular interface between the outside surface of the ion transfer device 104 and the inside surface of the wall 172 defining the opening 184 is prevented or at least significantly limited. Other walls (e.g., walls 176 and 180) separating adjacent chambers include openings (e.g., openings 194 and 196) that may function as gas conductance barriers, sampling or skimmer cones, ion optics, etc.

In operation, ions and gas 124 flow through the ion transfer device 104 under the influence of the pressure differential between the first chamber 128 and the second chamber 140. In some embodiments, the ion transfer device 104 includes one or more electrodes (e.g., electrically conductive or electrically resistive elements), such as for example at its inlet end 188 and/or outlet end 192, communicating with electrical circuitry (e.g., one or more voltage sources and/or electrical grounds). A voltage imparted between these electrodes generates an electric field across the axial length of the ion transfer device 104 that may assist in urging the ions through the ion transfer device 104. In the present context, the term "at" encompasses the term "proximate to" or "near." Hence, a component (such as an electrode) that is positioned at another component (such as an inlet or outlet) may be at or proximate to that other component. Generally, a component positioned at an inlet of a device is positioned nearer to the inlet than to a corresponding outlet of that device, and likewise a component positioned at the outlet is positioned nearer to the outlet than to the inlet.

In some embodiments, the ion transfer device 104 includes a heating device 198 to promote evaporation of droplets and desolvation of ions while the ions and droplets travel through the ion transfer device 104. Generally, the heating device 198 may be any device suitable for transferring heat to fluids flowing through the interior of the ion transfer device 104 by heat conduction or a combination of heat conduction and convection. The heating device 198 may or may not directly contact the ion transfer device 104. Heating devices suitable for use in ion source-mass spectrometer interfaces are generally known to persons skilled in the art.

According to an embodiment, an ion transfer device as described herein may be provided as part of an ion transfer system. For example, FIG. 1 illustrates an ion transfer system 102. The ion transfer system 102 may include a first chamber 128, a second chamber 140, a wall 172 separating the first chamber 128 and the second chamber 140, and an ion transfer device 104 configured according to any of the embodiments described herein. The second chamber 140 is configured to be evacuated down to a pressure lower than a pressure of the first chamber 128. The wall 172 has a wall thickness in the axial direction (i.e., in the direction of ion and gas flow through the ion transfer device 104), and includes a wall opening 184 extending through the wall thickness. The ion transfer device 104 is positioned at the wall 172 such that at least part of the ion transfer device 104 extends through or at least into the wall opening 184, and an inlet end 188 of the ion transfer device 104 faces (and may be disposed in) the first chamber 128 and an outlet end 192 of the ion transfer device 104 faces (and may be disposed in) the second chamber 140. By this configuration, a selected bore inlet (described below) of the ion transfer device 104 communicates with the first chamber 128 (which may be via an inlet port, as described below), and bore outlets (described below) of the ion transfer device 104 communicate with the second chamber 140.

According to an embodiment, an ion transfer system as described herein may be provided as part of a mass spectrometry (MS) system. For example, FIG. 1 illustrates an MS system 100. The MS system 100 may include an ion transfer system 102 configured according to any of the embodiments described herein (including an ion transfer device 104 configured according to any of the embodiments described herein), an atmospheric-pressure ionization (API) device 132 (such as may be part of an API source 108) configured for producing ions in a first chamber 128, a vacuum housing 112 enclosing a second chamber 140, and a mass analyzer 116 (or a mass spectrometer including the mass analyzer 116 and an ion detector 168) disposed in the vacuum housing 112.

Additional examples of an ion transfer device according to the present disclosure will now be described with reference to FIGS. 2A to 11.

Figure 2A:
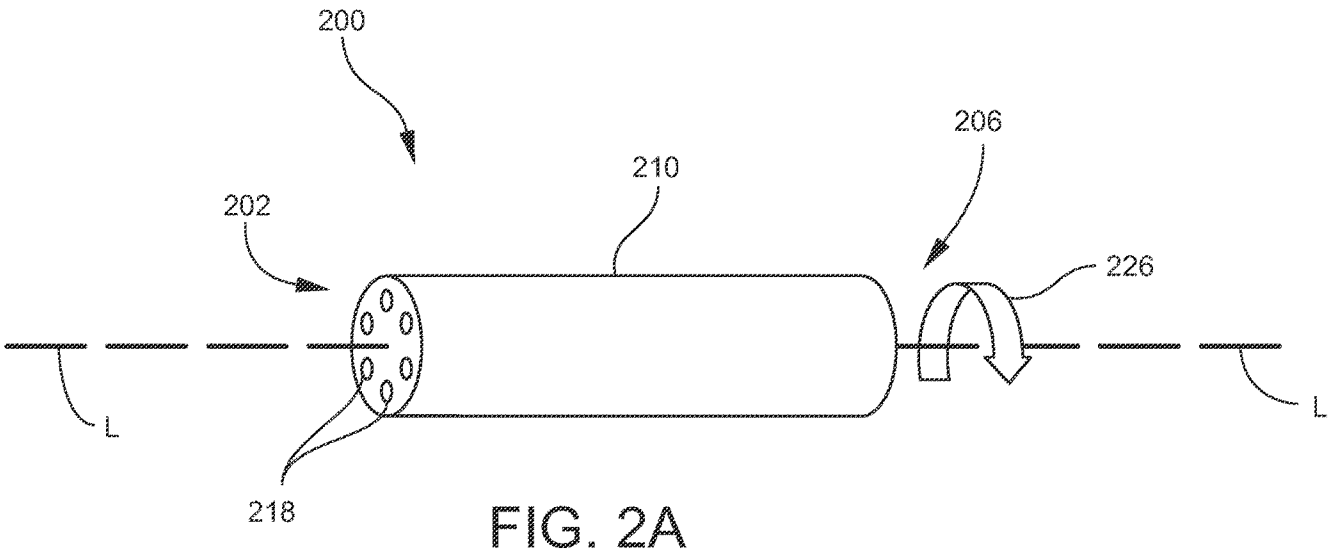
FIG. 2A is a perspective view of an example of a multi-bore ion transfer tube (or capillary) according to an embodiment of the present disclosure.
Figure 2B:
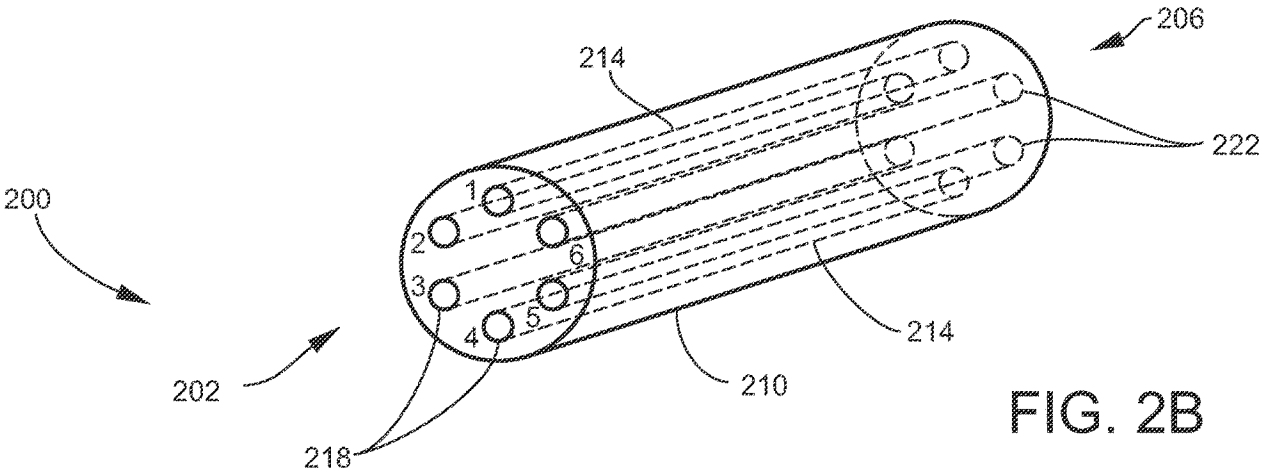
FIG. 2B is another perspective view of the multi-bore ion transfer tube illustrated in FIG. 2A.

FIGS. 2A and 2B are perspective views of an example of a multi-bore ion transfer tube (or tube, or capillary) 200 according to an embodiment of the present disclosure. The ion transfer tube 200 may be configured for use as, or as part of, an ion transfer device, such as the ion transfer device 104 of the ion transfer system 102 (or ion transfer system 102 and associated MS system 100) described above and illustrated in FIG. 1.

The ion transfer tube 200 generally includes an inlet end 202, an outlet end 206, and a body 210 elongated along a longitudinal device axis L of the ion transfer tube 200 from the inlet end 202 to the outlet end 206. The length of the body 210 from the inlet end 202 to the outlet end 206 defines the overall axial length of the ion transfer tube 200. In a typical but non-exclusive embodiment (and as illustrated), the ion transfer tube 200 is cylindrical and has a circular cross-section, thus having a diameter in the transverse plane orthogonal to the device axis L.

The ion transfer tube 200 further includes a plurality of ion transfer tube (or capillary) bores 214 extending through the body 210 from the inlet end 202 to the outlet end 206. The tube bores 214 are best illustrated in FIG. 2B in which the body 210 is transparent to facilitate viewing the tube bores 214. In practice, the material of the body 210 may be transparent (or translucent) or opaque. The tube bores 214 include respective bore inlets 218 at the inlet end 202 and respective bore outlets 222 at the outlet end 206. In the typical embodiment in which the ion transfer tube 200 is cylindrical with a circular cross-section, the tube bores 214 are circumferentially spaced from each other in the transverse plane about the device axis L, and are located at a radial distance in the transverse plane from the device axis L. Also in the typical embodiment, the tube bores 214 are parallel with the device axis L and thus with each other, while in other embodiments the tube bores 214 may converge toward or diverge away from the device axis L and each other. In an embodiment (and as illustrated), the inside diameters of the tube bores 214 are constant along the length of the body 210, such that the inside diameters of the bore inlets 218 are the same as the inside diameters of the bore outlets 222. In other embodiments, the inside diameters of the bore inlets 218 may vary, i.e., may be increased or reduced along the entire length of the body 210 (or in one or more axial sections of the body 210) in a gradual or step-wise manner in the direction of ion travel (i.e., toward the outlet end 206). Varying the inside diameters of the bore inlets 218 may done to achieve a desired effect on the mechanics of the ion flow and/or fluid flow into, through, or from the tube bores 214.

In FIG. 2B, the tube bores 214 are individually designated 1-6. Six tube bores 214, equally positioned sixty degrees apart from each other around the device axis L, are shown by example only. It will be understood, however, that in other embodiments the ion transfer tube 200 may include less or more than six tube bores 214.

According to the present disclosure, an ion transfer device including the multi-bore ion transfer tube 200 is configured to allow a user to select one or more of the tube bores 214 (i.e., one tube bore 214, or one group or set of tube bores 214) for active operation at any given time (e.g., during a given sample run) in an associated ion transfer system or MS system, while maintaining the other, non-selected tube bores 214 (or non-selected group(s) or set(s) of tube bores 214) in an inactive state. By such configuration, ions and fluids are able to flow through only the selected (active) tube bore 214 (or selected group of tube bores 214) and not through the non-selected (inactive) tube bores 214 (or non-selected group of tube bores 214). Accordingly, when the ion transfer device is appropriately positioned at a wall (e.g., the wall 172 shown in FIG. 1) partitioning one chamber (e.g., the first chamber 128 shown in FIG. 1) from another chamber (e.g., the second chamber 140 shown in FIG. 1), the tube bore(s) 214 selected for active operation provide the sole ion transfer path(s) (and fluid flow path(s)) from the one chamber to the other chamber.

A multi-bore ion transfer device as disclosed herein may provide one or more advantages. The multi-bore ion transfer device enables the selection of one tube bore 214 (or one group or set of tube bores 214) from a plurality of tube bores 214 available in the same ion transfer tube 200. The selected tube bore(s) 214 may be utilized for one or more sample runs. Subsequently, another one (or another group or set) of the tube bores 214 of the same tube 200 may be selected for use during one or more additional sample runs. The ability to switch from one tube bore 214 (or bore group or set) to another tube bore 214 (or bore group or set) extends the service life of the ion transfer device, i.e., increases the amount of time during which the ion transfer device may be operated before cleaning or replacement is required. The multi-bore ion transfer device thus also reduces the instrumental down time because the multi-bore ion transfer device requires less frequent iterations of maintenance.

Referring to FIG. 2B, for example, in a case where a single tube bore 214 is selected for active operation at any given time, tube bore 1 may initially be selected for active operation. After tube bore 1 has become contaminated to an unacceptable degree (e.g., as evidenced by a degradation in ion measurement signals produced by an MS system in which the ion transfer device is operating), the user may switch active operation to tube bore 2, thereby restoring signal intensity during one or more subsequent sample runs. After tube bore 2 has become contaminated to an unacceptable degree, the user may then switch active operation to tube bore 3, and so on. After all tube bores 1-6 have become contaminated to an unacceptable degree, the ion transfer device may at that time be removed from the associated system and cleaned or replaced as needed. In the example of an ion transfer device providing six switchable tube bores 214, the service life may be six times longer than a conventional single-bore ion transfer device or a multi-bore ion transfer device that does not provide for selection among individual tube bores or individual groups of tube bores.

In the above example, the ion transfer device may be operated at six different (and successive) active positions before needing to be removed and serviced (cleaned or replaced). More generally, the number of active positions available for use between service times will depend on the total number of tube bores 214 provided by the ion transfer tube 200 and the number of tube bores 214 assigned to each bore group (if any). In comparison to the above example, in another example, the ion transfer tube 200 again contains a total of six tube bores 214, but three bore groups each containing two tube bores 214 are defined. Namely, a first bore group contains tube bores 1 and 2 (or 1 and 3), a second bore group contains tube bores 3 and 4 (or 2 and 4), and a third bore group contains tube bores 5 and 6 (or 3 and 6). In this case, the ion transfer device may be operated at three different active positions (corresponding to the three different bore groups) before needing to be removed and serviced. In another example, the ion transfer tube 200 again contains a total of six tube bores 214, but two bore groups each containing three tube bores 214 are defined. Namely, the first bore group contains tube bores 1, 2 and 3, and the second bore group contains tube bores 4, 5, and 6. In this case, the ion transfer device may be operated at two different active positions (corresponding to the two different bore groups) before needing to be removed and serviced.

As another advantage, variations in instrumental response caused by variations in the conditions of fabrication of different single-bore ion transfer tubes (e.g., variations in bore diameter, coating conductivity, thermal expansion, etc.) may be minimized, because all the bores of the multi-bore ion transfer tube may be formed during the same fabrication process and hence under the same fabrication conditions. In addition, the cost of fabricating a multi-bore ion transfer tube may be less than the cost of fabricating an equivalent number of single-bore ion transfer tubes.

In an embodiment, the selection of a tube bore 214 (e.g., one of tube bores 1-6 in FIG. 2B) or a bore group for active operation may be done by aligning the selected tube bore 214 or bore group with an inlet port of the ion transfer device (or optionally with more than one inlet port in the case of a selectable bore group), i.e., by placing the selected tube bore 214 or bore group in fluid communication with the inlet port(s). The inlet port(s), examples of which are described below, provide the only fluid communication between the selected tube bore 214 or bore group (specifically, the bore inlet(s) 218 of the selected tube bore 214 or bore group) and the chamber (e.g., the first chamber 128 shown in FIG. 1) on the inlet side of the ion transfer device, while preventing fluid communication between the non-selected tube bores 214 or bore group(s) and the inlet-side chamber. The selection of a tube bore 214 or bore group may be done by moving the ion transfer tube 200 relative to the inlet port(s) (which in this case may be stationary, i.e., mounted in a fixed position) until the selected tube bore 214 or bore group is aligned with the inlet port(s), or by moving the inlet port(s) relative to the selected tube bore 214 or bore group (which in this case may be stationary, i.e., mounted in a fixed position) until the inlet port(s) is/are aligned with the selected tube bore 214 or bore group, or by moving both the selected tube bore 214 or bore group and the inlet port(s) until alignment is achieved. In one embodiment, the movement entails a rotation of the ion transfer tube 200 (as depicted by an arrow 226 in FIG. 2A) and/or the inlet port(s) about the device axis L, as described further below.

Figure 9:
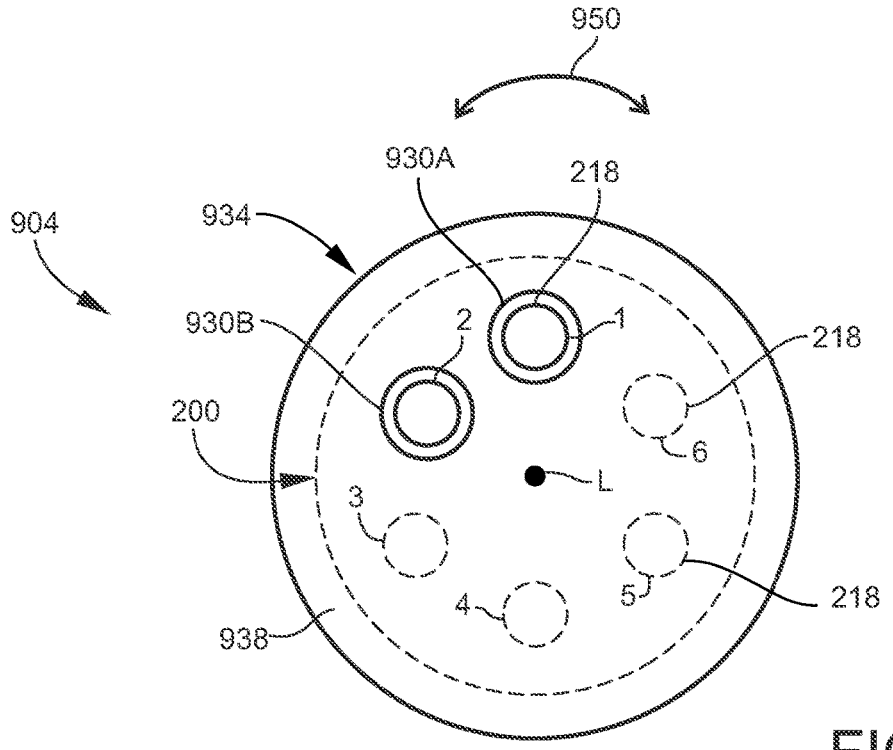
FIG. 9 is an end view of an example of an ion transfer device according to another embodiment of the present disclosure.
Figure 10:
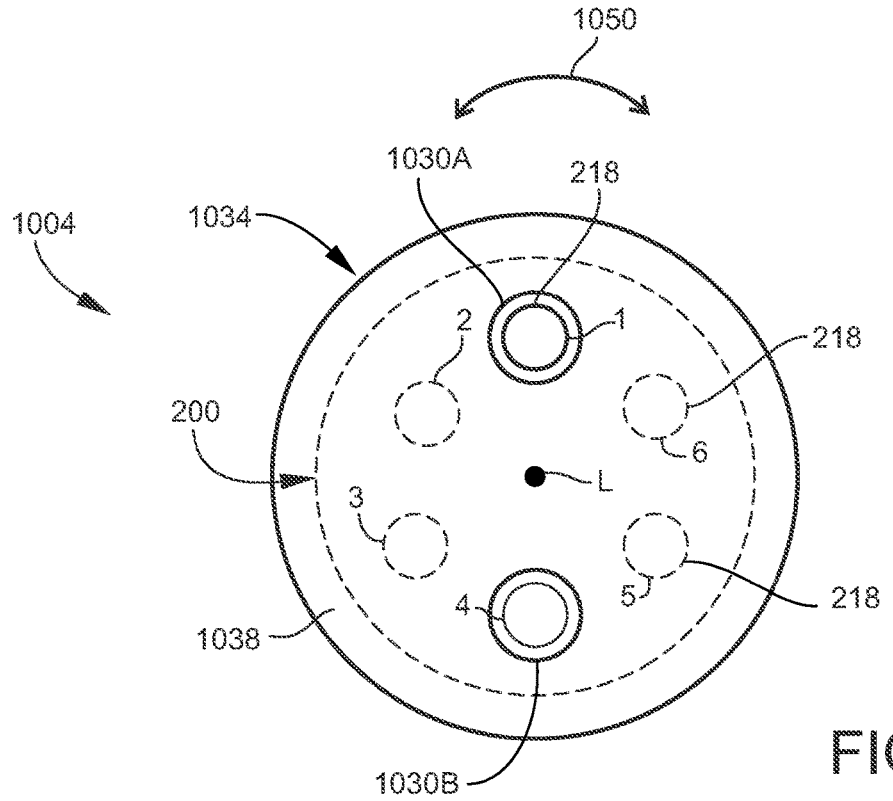
FIG. 10 is an end view of an example of an ion transfer device according to another embodiment of the present disclosure.

FIGS. 3A-8 illustrate examples in which a single tube bore 214 is selected for active operation at any given time. FIGS. 9 and 10 illustrate examples in which a single group (or set) of tube bores 214 is selected for active operation at any given time. In the latter case, two or more inlet ports may be provided in some embodiments, as described further below.

Figure 3A:
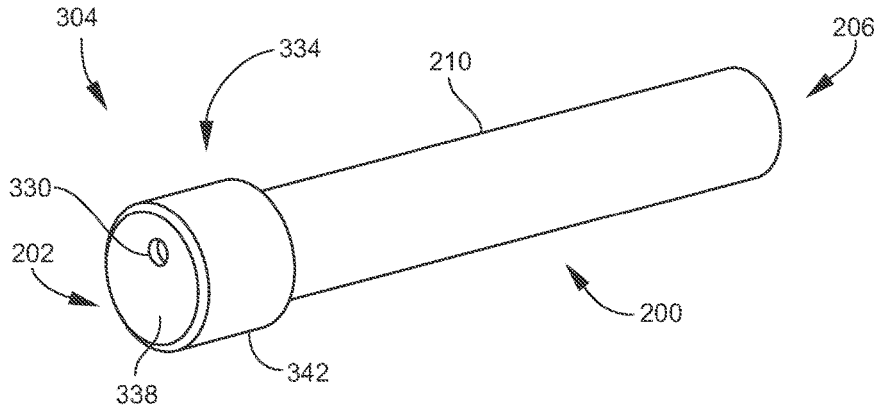
FIG. 3A is a perspective view of an example of an ion transfer device according to an embodiment of the present disclosure.
Figure 3B:
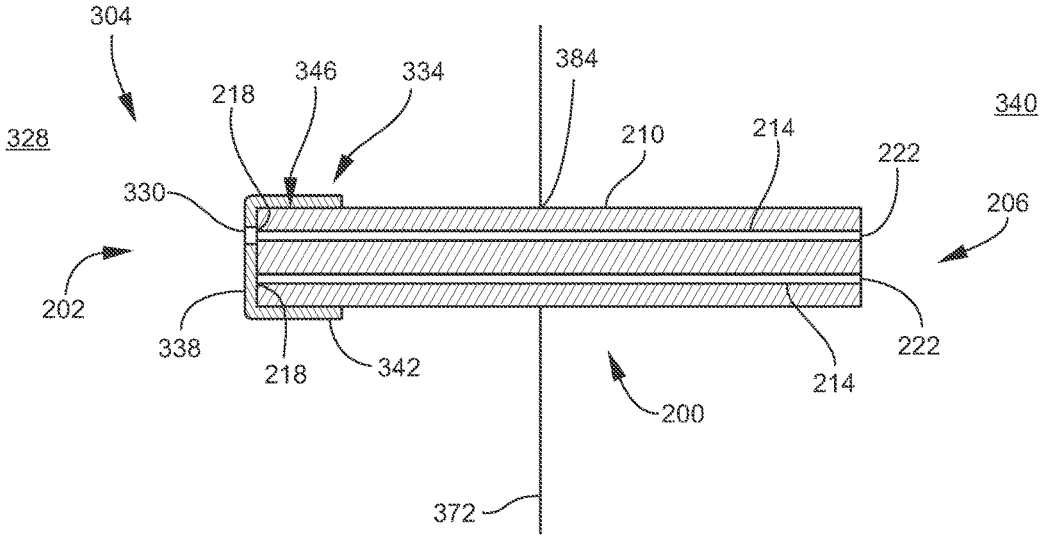
FIG. 3B is a cross-sectional side (lengthwise) view of the ion transfer device illustrated in FIG. 3A.
Figure 3C:
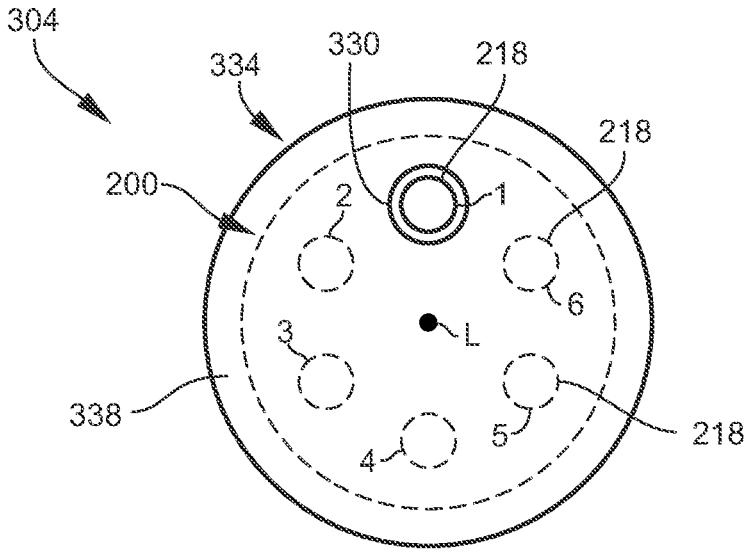
FIG. 3C is an end view of the ion transfer device illustrated in FIG. 3A, specifically at an inlet end thereof.

FIG. 3A is a perspective view of an example of an ion transfer device 304 according to an embodiment of the present disclosure. The ion transfer device 304 includes a multi-bore ion transfer tube, such as the ion transfer tube 200 described above and illustrated in FIGS. 2A and 2B. FIG. 3B is a cross-sectional side (lengthwise) view of the ion transfer device 304. In FIG. 3B, for simplicity only two tube bores 214 of the ion transfer tube 200 are shown. FIG. 3C is an end view of the ion transfer device 304, specifically at its inlet end 202 (FIGS. 3A and 3B). In FIG. 3C, the tube bores 214 (FIGS. 2B and 3B) are individually designated 1-6, respectively, in the same manner as shown in FIG. 2B.

The ion transfer device 304 may be configured for use in the ion transfer system 102 (as may be provided in the MS system 100) described above and illustrated in FIG. 1, and thus may correspond to the ion transfer device 104 described above and illustrated in FIG. 1. For example, as illustrated in FIG. 3B, the ion transfer device 304 may positioned at an opening 384 of a wall 372 that separates a first chamber 328 (e.g., held at atmospheric pressure) and a second chamber 340 (e.g., held at sub-atmospheric pressure). Thus, as described herein, the ion transfer device 304 may be configured to transfer ions from the first chamber 328 to the second chamber 340 along an ion transfer path that runs through a user-selected tube bore 214 of the ion transfer device 304.

In addition to the multi-bore ion transfer tube 200, the ion transfer device 304 further includes an ion transfer bore selector (or bore selector, or ion inlet structure) 334 configured to enable selection of one (or one group) of the tube bores 214 of the ion transfer tube 200 for active operation while maintaining the other tube bores 214 in a non-active state. In this manner, the ion transfer bore selector 334 is configured to enable selection of which tube bore(s) 214 establish the ion transfer path(s) through the ion transfer device 304, while simultaneously blocking ion and fluid flow through the other, non-selected tube bores 214 (or bore groups), at any given time during the operation of the ion transfer device 304 in the associated ion transfer system 102 or MS system 100. For this purpose, in the present embodiment, the ion transfer bore selector 334 includes an inlet port 330 (or two or more inlet ports in a case where multiple tube bores 214 are to be active at a given time). The position of the inlet port 330 is radially offset from the device axis L (FIG. 3C) such that the centerline of the inlet port 330 will be (at least substantially) collinear with the centerline of a selected tube bore 214 when the selected tube bore 214 is aligned with the inlet port 330. The ion transfer bore selector 334 is configured and positioned in the ion transfer system 102 or MS system 100 such that the inlet port 330 communicates with the first chamber 328. The inlet port 330 provides the sole means for communication between the first chamber 328 and any tube bore 214 selected for active operation. A tube bore 214 is selected by placing that tube bore 214 in communication with the inlet port 330 and thereby in communication with the first chamber 328 via the inlet port 330. In the example shown in FIG. 3C, tube bore 1 is aligned with the inlet port 330 so as to be in open communication with the inlet port 330, and thus tube bore 1 is in an active state that establishes an ion transfer path from the first chamber 328, through the ion transfer device 304 (via the inlet port 330 and tube bore 1), and to the second chamber 340. The ion transfer bore selector 334 is structured such that the bore inlets 218 of the other, non-selected tube bores 2-6 are blocked while the selected tube bore 1 is active, i.e., ion and fluid flow from the first chamber 328 into the other tube bores 2-6 is prevented. As the ion transfer path is dictated by which one of the bore inlets 218 (or which group of bore inlets 218) is in open communication with the first chamber 328, all the bore outlets 222 may be in open communication with the second chamber 340 regardless of which tube bore or bores 1-6 are actively communicating with the first chamber 328 at any given time.

In an embodiment, the ion transfer bore selector 334 is or includes a cover or end wall 338 positioned at the end face of the ion transfer tube 200. The inlet port 330 is formed through the axial thickness of the end wall 338. The end wall 338 is configured (i.e., positioned, shaped, and sized) such that it covers the bore inlets 218 of the tube bores 214 except for a selected one of the tube bores 214 (or bore group) when the bore inlet (or inlets) 218 of the selected tube bore 214 (or bore group) is/are aligned with the inlet port(s) 330 of the end wall 338.

In the embodiment specifically illustrated, the ion transfer bore selector 334 is embodied as an end cap or inlet cap enclosing the ion transfer tube 200 at least at the inlet end 202. For example, the ion transfer bore selector 334 may include the cover or end wall 338 adjacent to the end face of the ion transfer tube 200 at which the bore inlets 218 are located, and a lateral wall 342 adjoining the end wall 338 and surrounding a portion of the outer lateral surface of the ion transfer tube 200 at the inlet end 202. In such embodiment, the bore selector 334 is shaped as a cap or cup, thus having a receptacle or cavity 346 (FIG. 3B) into which the ion transfer tube 200 (at least the inlet end 202 thereof) extends when the ion transfer device 304 is assembled. As best shown in FIG. 3C, the inlet port 330 is positioned such that its centerline is located at (at least substantially) the same radial distance from the device axis L as the centerlines of the bore inlets 218. In the example shown in FIG. 3C in which the tube bore 1 is selected for active operation, the end wall 338 blocks or covers the bore inlets 218 of the other, non-selected tube bores 2-6. In other embodiments in which a group of tube bores (e.g., tube bores 1 and 2, tube bores 1 and 3, etc.) is selected for active operation, the end wall 338 blocks or covers the bore inlets 218 of the other, non-selected bore groups.

In the illustrated embodiment, the inlet port 330 is circular. In other embodiments, however, the inlet port 330 may have a different shape such as, for example, an elliptical shape, slot shape, etc. Generally, any shape capable of exposing a selected tube bore 214 (or bore group) without impairing ion collection and entry into the selected tube bore 214 (or bore group) may be suitable.

In the present embodiment, selecting one of the tube bores (or bore groups) 1-6 for active operation entails moving (e.g., rotating) the ion transfer tube 200 about the device axis L relative to the ion transfer bore selector 334, and/or rotating the ion transfer bore selector 334 about the device axis L relative to the ion transfer tube 200. Rotation may be done manually by a user. The ion transfer tube 200 and/or ion transfer bore selector 334 to be rotated may include structural features configured to facilitate manipulation of the ion transfer tube 200 and/or ion transfer bore selector 334 by the user. Examples include, but are not limited to, radially outward extending wings (e.g., similar to the wings of a wingnut) or spokes, one or more outer surfaces having knurled or other raised or three-dimensional features, male or female engagement members configured to engage a complementary female or male engagement member of a tool, etc., as appreciated by persons skilled in the art. Alternatively, the ion transfer tube 200 and/or ion transfer bore selector 334 may be coupled to a device that is for example powered by a stepper motor and configured to effect rotation in an automated, powered manner.

Figure 4:
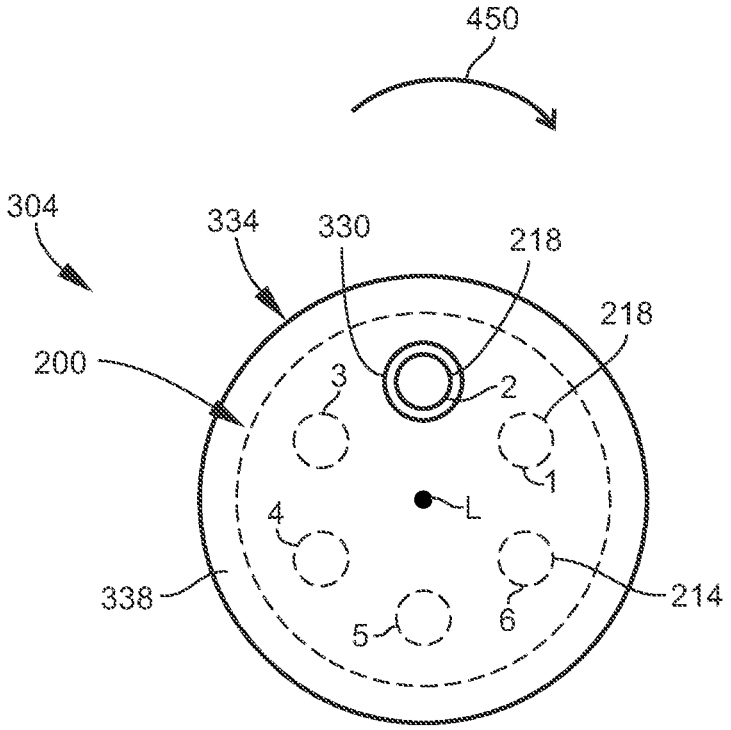
FIG. 4 is an end view of the ion transfer device illustrated in FIG. 3A, specifically at an inlet end thereof, according to an embodiment in which a multi-bore ion transfer tube is rotated about a device axis relative to an ion transfer bore selector.

FIG. 4 is an end view of the ion transfer device 304, specifically at its inlet end 202 (FIGS. 3A and 3B), according to an embodiment in which the ion transfer tube 200 is rotated about the device axis L relative to the ion transfer bore selector 334, as indicated by an arrow 450. The rotation may be clockwise as illustrated or counterclockwise. In this embodiment, rotation of the ion transfer tube 200 indexes the positions of the tube bores 1-6 in comparison to FIG. 3C, such that tube bore 2 now provides the active ion transfer path while tube bores 1 and 3-6 are non-active. That is, tube bore 2 has been moved into alignment with the inlet port 330 for communication with the first chamber 328 while tube bores 1 and 3-6 are prevented from communicating with the first chamber 328.

Figure 5:
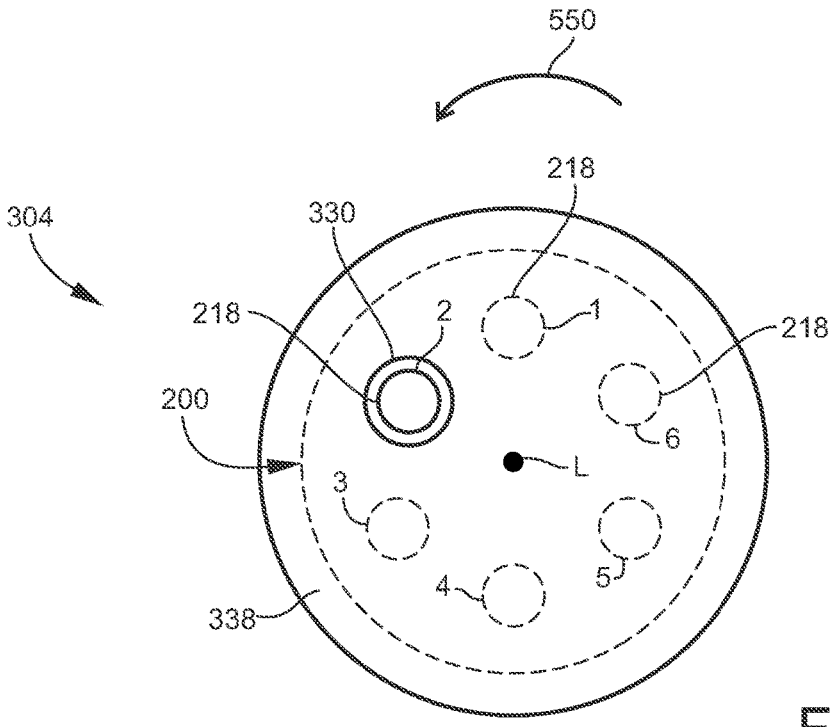
FIG. 5 is an end view of the ion transfer device illustrated in FIG. 3A, specifically at an inlet end thereof, according to an embodiment in which an ion transfer bore selector is rotated about a device axis relative to a multi-bore ion transfer tube.

By comparison, FIG. 5 is an end view of the ion transfer device 304, specifically at its inlet end 202 (FIGS. 3A and 3B), according to an embodiment in which the ion transfer bore selector 334 is rotated about the device axis L relative to the ion transfer tube 200, as indicated by an arrow 550. The rotation may be counterclockwise as illustrated or clockwise. In this embodiment, rotation of the ion transfer bore selector 334 indexes the position of the inlet port 330 in comparison to FIG. 3C, such that tube bore 2 now provides the active ion transfer path while tube bores 1 and 3-6 are non-active. That is, the inlet port 330 has been moved into alignment with tube bore 2, whereby tube bore 2 communicates with the first chamber 328 while tube bores 1 and 3-6 are prevented from communicating with the first chamber 328.

As non-exclusive examples, an ion transfer device according to any of the embodiments disclosed herein may have dimensions as follows. Each tube bore 214 may have a bore length along the device axis L from the bore inlet 218 to the bore outlet 222 in a range from 30 mm to 200 mm. Each tube bore 214 may have an inside diameter in a range from 0.1 mm to 1 mm. The ion transfer tube 200 may have an outer diameter in a range from 0.5 mm to 20 mm. The inlet bore 330 may have an inside diameter in a range from 0.05 mm to 3 mm.

Figure 6:
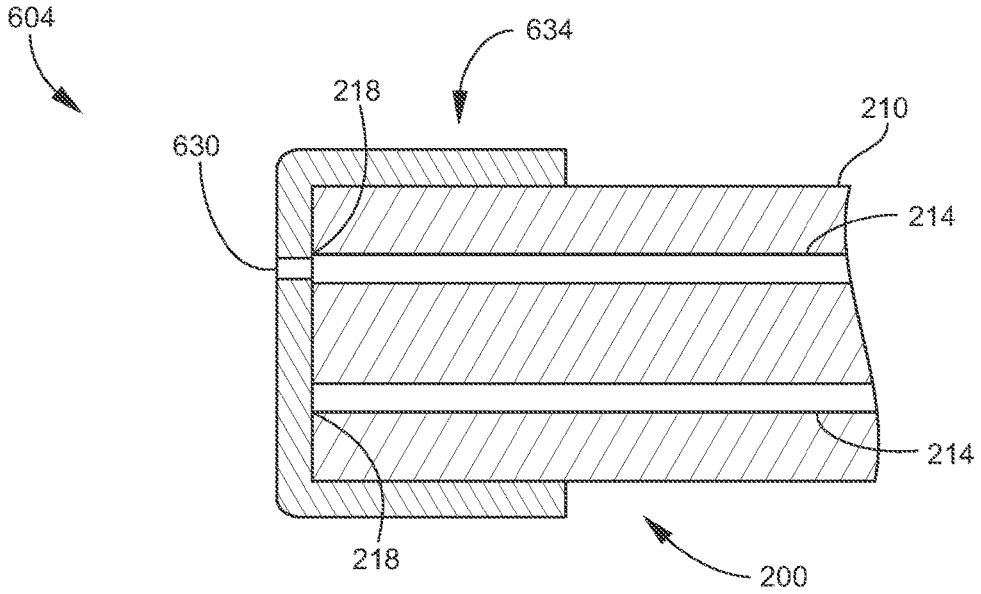
FIG. 6 is a side (lengthwise) view of an example of an inlet end of an ion transfer device that includes an inlet port with a diameter smaller than a diameter of bore inlets of a multi-bore ion transfer tube, according to an embodiment of the present disclosure.

In the embodiments illustrated in FIGS. 2A-5, the diameter of the inlet port 330 is larger than the diameter of the bore inlets 218. The difference in diameter may be advantageous in that it affords some tolerance in misalignment between the inlet port 330 and the selected bore inlet 218. More generally, however, the diameter of the inlet port 330 may be larger than, equal to (or substantially equal to), or smaller than the diameter of the bore inlets 218. FIG. 6 is a side (lengthwise) view of the inlet end of an example of an ion transfer device 604 that includes an inlet port 630 (provided by example as part of an ion transfer bore selector 634, as described above) with a diameter smaller than the diameter of the bore inlets 218. Here again, the difference in diameter may be advantageous in that it affords some tolerance in misalignment between the inlet port 630 and the selected bore inlet 218. The determination of whether the diameter of the inlet port 330 (or 630) is to be larger or smaller than the diameter of the bore inlets 218 may be based on considerations relating to optimizing operating parameters of the ion transfer device 304 (or 604) relating to fluid mechanics and/or ion extraction. As one example, providing the inlet port 630 with a diameter smaller than that of the bore inlet 218 will allow the gas to accelerate to the speed of sound at the location where the diameter is increased going from inlet port 630 to tube bore 214. The gas flow speed at the entrance of the inlet port 630 is also increased. This increased gas speed serves to entrain ions from a larger diameter in front of the entrance of the inlet port 630 and, due to the increased flow speed, the charge density of the ions inside the active tube bore 214 is reduced and the residence time in the active tube bore 214 is also reduced. These conditions are expected to result in a reduction of the ion (and neutral) contamination in the active tube bore 214. Further discussion of such considerations is provided in above-referenced U.S. Patent Application No. US 2018/0068840.

In another embodiment, the movement utilized for switching among different tube bores 214 may involve linear translation of the ion transfer tube 200 and/or the ion transfer bore selector 334 along one or more axes instead of rotation about the device axis L. In such case, the tube bores 214 may be arranged in a one-dimensional array or two-dimensional array (e.g., rows and columns) instead of a circular array. One example of such embodiment is described below and illustrated in FIG. 11.

An ion transfer device (e.g., 104, 304, 604, etc.) according to any of the embodiments disclosed herein may be supported by any suitable support structure when operatively installed in an ion transfer system or MS system, such as the ion transfer system 102 and associated MS system 100 described above and illustrated in FIG. 1. The support structure may be configured to constrain all translational movement of the ion transfer device along the device axis L and along radial or transverse directions orthogonal to the device axis L, except for allowing the type and direction of movement (e.g., rotation or translation) of the ion transfer tube 200 and/or the ion transfer bore selector 334 or 634 needed to switch active operation from one tube bore 214 (or bore group) to another tube bore 214 (or bore group) in the manner described herein. In other words, the support structure may be configured to fix the position of the ion transfer device except for the degree of freedom needed to index the tube bores 214 (or bore groups) between active and inactive states. The support structure also allows for the ion transfer device to be installed at, removed from, and reinstalled at the site of operation (e.g., an ion transfer system or MS system).

For these purposes, the support structure may be configured to contact the ion transfer tube 200 and/or the ion transfer bore selector 334 or 634. The support structure may include a support structure opening that surrounds at least a portion of the ion transfer tube 200 and/or the ion transfer bore selector 334 or 634. For example, the support structure may be part of or attached to the wall 172 or 372 between the first chamber 128 or 328 and/or the second chamber 140 or 340, in which case the support structure opening may correspond to or be positioned at the opening 184 or 384 of the wall 172 or 372 shown in FIG. 1 or 3B. Alternatively or additionally, the support structure (or different parts thereof) may be disposed in the first chamber 128 or 328 and the second chamber 140 or 340. Moreover, the support structure may be an arrangement or assembly that includes two or more support structures (or support members) supporting the ion transfer device (e.g., 104, 304, 604, etc.) at different points along its axial length. For example, the support structure may include a front support structure contacting the ion transfer tube 200 and/or the ion transfer bore selector 334 or 634 at or proximate to the inlet end 202, and a rear support structure contacting the ion transfer tube 200 at or proximate to the outlet end 206.

In one embodiment, the front support structure may be disposed in the first chamber 128 or 328, and the rear support structure may be part of or attached to the wall 172 or 372 between the first chamber 128 or 328 and the second chamber 140 or 340. In another embodiment, the front support structure may be part of or attached to the wall 172 or 372, and the rear support structure may be disposed in the second chamber 140 or 340. In yet another embodiment, the front support structure may be disposed in the first chamber 128 or 328, the rear support structure may be disposed in the second chamber 140 or 340, and an intermediate support structure may be part of or attached to the wall 172 or 372.

A suitable sealing member (i.e., one or more sealing members) may be disposed in the support structure opening and surround the ion transfer tube 200 and/or the ion transfer bore selector 334 or 634. The sealing member may be configured to limit conductance of gas through the support structure opening between the support structure and the ion transfer tube 200 or the ion transfer bore selector 334 or 634, e.g., through any annular gap existing between the support structure and the ion transfer tube 200 or the ion transfer bore selector 334 or 634. At the same time, the sealing member may be configured to allow movement (e.g., rotation) of the ion transfer tube 200 and/or the ion transfer bore selector 334 or 634 as needed to switch active operation from one tube bore 214 (or bore group) to another tube bore 214 (or bore group). The sealing member may also be configured to conduct electrical current (or accommodate the conduction of electrical current) between a voltage source and the ion transfer tube 200 or the ion transfer bore selector 334 or 634 as needed to provide (if desired) an electrical field across the length of the ion transfer device.

Figure 7:
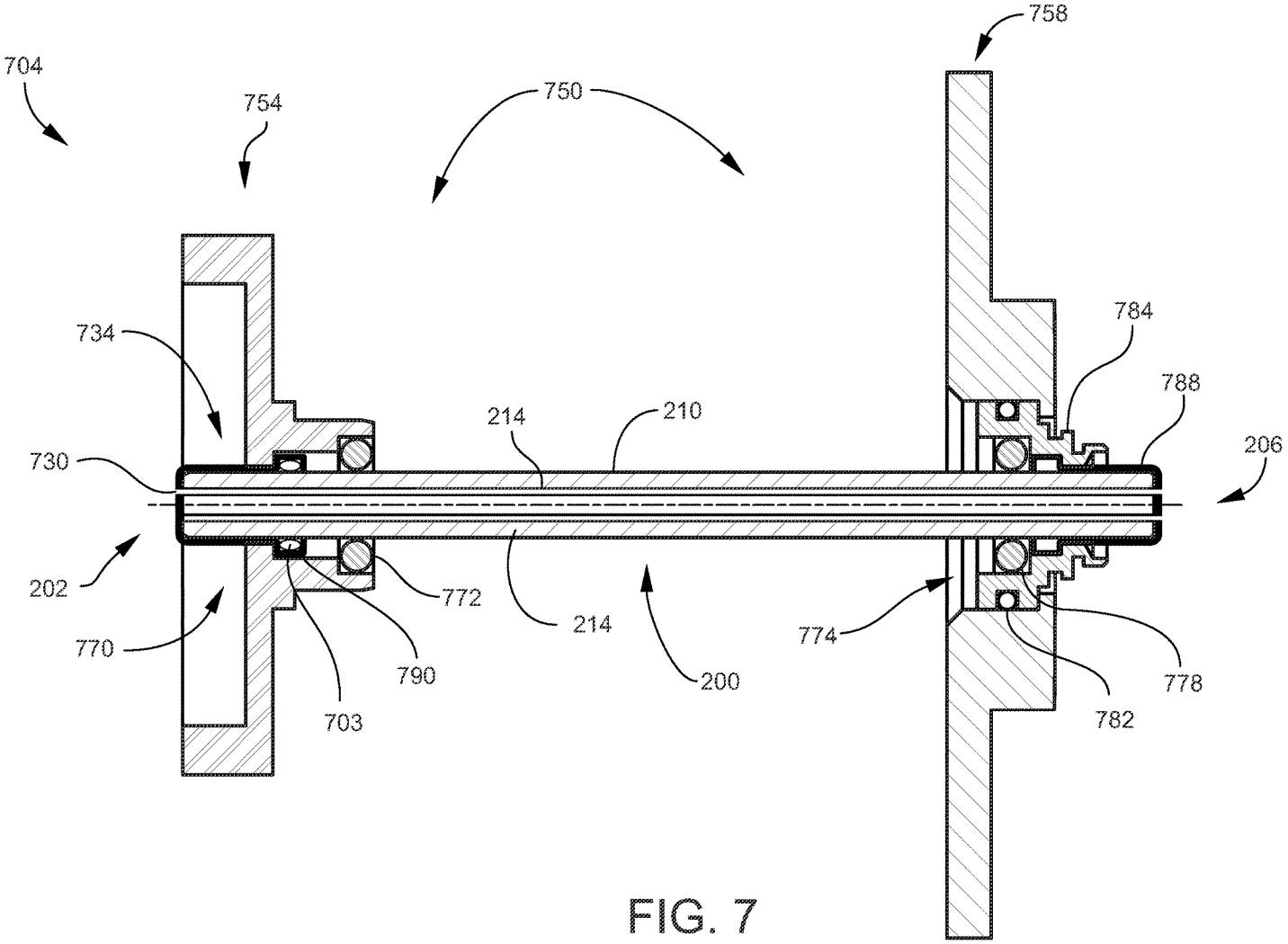
FIG. 7 is a cross-sectional side (lengthwise) view of an example of an ion transfer device according to another embodiment of the present disclosure.

FIG. 7 is a cross-sectional side (lengthwise) view of an example of an ion transfer device (or ion transfer device assembly) 704 according to an embodiment of the present disclosure. The ion transfer device 704 includes a multi-bore ion transfer tube, such as the ion transfer tube 200 described above and illustrated in FIGS. 2A and 2B, and an ion transfer bore selector 734 configured to enable selection of one of the tube bores 214 (or group of tube bores 214) of the ion transfer tube 200 for active operation while maintaining the other tube bores 214 (or groups of tube bores 214) in a non-active state. The ion transfer bore selector 734 includes one or more inlet ports 730 as described above. The ion transfer bore selector 734 is configured to enable the bore selection by moving the ion transfer tube 200 relative to the ion transfer bore selector 734 (and thus the inlet port(s) 730) and/or moving the ion transfer bore selector 734 (and thus the inlet port(s) 730) relative to the ion transfer tube 200, as described above. The ion transfer device 704 may be configured for operation in an ion transfer system or MS system, such as the ion transfer system 102 and associated MS system 100 described above and illustrated in FIG. 1.

The ion transfer device 704 further includes a support structure 750 configured to support the ion transfer device 704 (i.e., the ion transfer tube 200 and/or the ion transfer bore selector 734) when the ion transfer device 704 is installed at an operational site (e.g., the ion transfer system 102 or MS system 100). In the illustrated embodiment, the support structure 750 includes a front support structure or member 754 disposed at the inlet end 202 and a rear support structure or member 758 disposed at the outlet end 206. In the present context, the term "at" generally encompasses "at or proximate to." Additionally, the terms "front," "at the inlet end," and "proximate to the inlet end" are generally taken to mean a component (e.g., the front support structure 754) is nearer to the inlet end than another component (e.g., the rear support structure 758) is to the inlet end. Likewise, the terms "rear," "at the outlet end," and "proximate to the outlet end" are generally taken to mean a component (e.g., the rear support structure 758) is nearer to the outlet end than another component (e.g., the front support structure 754) is to the outlet end.

The front support structure 754 includes a front support structure opening 770 into or through which at least a portion of the ion transfer tube 200, or both the ion transfer tube 200 and the ion transfer bore selector 734, extend. As illustrated, the front support structure opening 770 may include sections of differing or varying inside diameters as needed to accommodate various features of the ion transfer device 704. The front support structure 754 may include one or more sealing members 772 configured to limit gas conductance through the front support structure opening 770 such that most or all gas flows only through the tube bore(s) 214 currently selected for active operation. The sealing member 772 may be configured to occupy an annular space between an inside surface of the front support structure 754 (e.g., a surface defining the front support structure opening 770) and the outside surface of the ion transfer tube 200 or ion transfer bore selector 734. The sealing member 772 may be further configured to contact the outside surface of the ion transfer tube 200 or ion transfer bore selector 734 while permitting the ion transfer tube 200 or ion transfer bore selector 734 to be moved (e.g., rotated about the device axis) to enable switching the tube bores 214 between active and inactive states. In the illustrated embodiment, the sealing member 772 is a resilient o-ring or annular gasket surrounding the ion transfer tube 200, or both the ion transfer tube 200 and the ion transfer bore selector 734, depending on the axial position of the sealing member 772.

The rear support structure 758 includes a rear support structure opening 774 into or through which at least a portion of the ion transfer tube 200 extends. As illustrated, the rear support structure opening 774 may include sections of differing or varying inside diameters as needed to accommodate various features of the ion transfer device 704. The rear support structure 758 may include one or more sealing members 778 configured to limit gas conductance through the rear support structure opening 774 such that most or all gas flows only through the tube bore(s) 214 currently selected for active operation. The sealing member 778 may be configured to occupy an annular space between an inside surface of the rear support structure 758 (e.g., a surface defining the rear support structure opening 774) and the outside surface of the ion transfer tube 200. The sealing member 778 may be further configured to contact the outside surface of the ion transfer tube 200 while (in some embodiments as described herein) permitting the ion transfer tube 200 to be moved (e.g., rotated about the device axis) to enable switching the tube bores 214 between active and inactive states. In the illustrated embodiment, the sealing member 778 is a resilient o-ring or annular gasket surrounding the ion transfer tube 200.

In the illustrated embodiment, the rear support structure 758 may be part of or attached to the wall 172 between the first chamber 128 and the second chamber 140 (FIG. 1). In such embodiment, the fluid sealing provided at the rear support structure 758 may be more robust than the fluid sealing provided at the front support structure 754 to facilitate maintaining a pressure differential between the atmospheric-pressure first chamber 128 and the sub-atmospheric-pressure second chamber 140. As one non-exclusive example, the rear support structure 758 may include a sealing member 782 specifically configured for use as a vacuum seal. The sealing member 782 may be, for example, a resilient o-ring or annular gasket occupying an annular groove of a seal support 784, such that the sealing member 782 is positioned radially between an inside surface of the rear support structure 758 defining at least a portion of the rear support structure opening 774 and the outside surface of the seal support 784 defining the seal support groove. In the illustrated embodiment, the other sealing member 778 is positioned radially between an inside surface of the seal support 784 and the outside surface of the ion transfer tube 200. Also in this embodiment, the front support structure 754 may be disposed in the first chamber 128 and mounted appropriately therein, such as by attachment to a wall of the first chamber 128.

In another embodiment, the front support structure 754 may be part of or attached to the wall 172 between the first chamber 128 and the second chamber 140 (FIG. 1). In such embodiment, the fluid sealing provided at the front support structure 754 may be specifically configured to maintain vacuum on the outlet side of the ion transfer device 704 (e.g., in the second chamber 140), and accordingly may provide sealing components similar to the sealing member 782 and seal support 784 described above. In this embodiment, the rear support structure 758 may be disposed in the second chamber 140 and mounted appropriately therein, such as by attachment to a wall of the second chamber 140.

In yet another embodiment, the front support structure 754 may be disposed in the first chamber 128, the rear support structure 758 may be disposed in the second chamber 140, and an intermediate support structure (not shown) may be part of or attached to the wall 172 (FIG. 1).

As also illustrated in FIG. 7, the ion transfer device 704 may include a mechanical stop 788 such as an end cap (or outlet cap) enclosing at least a portion of the outlet end 206. The mechanical stop 788 engages the rear support structure 758, such as by an abutment between complimentary shoulders of the mechanical stop 788 and the rear support structure 758, in a manner that prevents axial translation of the ion transfer tube 200 in the direction of vacuum. This configuration ensures that the ion transfer tube 200 is not drawn into the vacuum of the second chamber 140 by the more positive pressure of the first chamber 128 (FIG. 1). The axial end section of the mechanical stop 788 includes orifices aligned with the bore outlets of the tube bores 214 to accommodate fluid communication between the tube bores 214 and the second chamber 140.

As also illustrated in FIG. 7, the ion transfer bore selector 734 may include an inside groove 790 that defines an annular space between a portion of the inside surface of the ion transfer bore selector 734 and the outside surface of the ion transfer tube 200. For example, the inside groove 790 may be formed in a flanged section of the ion transfer bore selector 734. In an embodiment, an electrically conductive component 703 is positioned in the inside groove 790 and configured to maintain contact with both the ion transfer bore selector 734 and the ion transfer tube 200, while also accommodating movement (e.g., rotation) of the ion transfer bore selector 734 and/or the ion transfer tube 200 relative to the other in the manner described herein. The electrically conductive component 703 is useful when it is desired to maintain the ion transfer bore selector 734 and the ion transfer tube 200 at the same voltage potential during operation. One non-exclusive example of a suitable electrically conductive component 703 is a canted coil spring, i.e., a wire formed as a series of coils arranged as an annulus or ring about the device axis. Canted coil springs are described in, for example, U.S. Pat. No. 4,830,344, the contents of which are incorporated herein by reference, and commercially available from Bal Seal Engineering, Inc., Foothill Ranch, Calif., USA.

The (body 210 of the) ion transfer tube 200 and the ion transfer bore selector 334 (or 634 or 734) providing the inlet bore(s) 330 (or 630 or 730) may have the same composition or different compositions. Generally, as non-exclusive examples, the composition of the ion transfer tube 200 and/or the ion transfer bore selector 334 may be an electrically conductive material (e.g., a metal, metal alloy, conductive plastic, etc.), an electrically insulating material (e.g., a glass, fused silica, metal oxide, other type of ceramic, metal nitride, insulating or dielectric polymer, etc.), an electrically insulating (or dielectric) material with bulk electrical resistance, or an electrically insulating (or dielectric) material with surface electrical resistance.

It may be desirable to generate an axial electrical field across the length of the ion transfer device 304 (or 604 or 704) by coupling voltage sources to the ion transfer tube 200 and/or the ion transfer bore selector 334 (or 634 or 734) at or near the inlet end 202, and to the ion transfer tube 200 at or near the outlet end 206. For this purpose, the ion transfer tube 200 and/or the ion transfer device 304 if composed of insulating materials may include outer conductive coatings or electrically resistive coatings serving as electrodes (conductive or resistive elements) on the outer surfaces of the ion transfer tube 200 and/or the ion transfer device 304. A resistive coating may be formed, for example, from a resistive ink such as a carbon ink, cermet ink, metallic ink, conductive plastic ink, or polymer ink, as further described in U.S. Pat. No. 7,064,322, the entire contents of which are incorporated by reference herein. Separate electrodes or coatings may be independently addressable by respective voltage sources, thereby enabling the generation of a potential difference of desired magnitude across a desired axial section or sections of the ion transfer device 304. Alternatively, the insulating material utilized for the ion transfer tube 200 and/or the ion transfer device 304 may have a bulk resistance that enables generation of an electric field in response to application of voltages. In an embodiment, the ion transfer tube 200 may be fabricated in segments, with the tube segments being independently addressable by respective voltage sources to enable the application of a highly controlled axial voltage gradient if desired.

Figure 8:
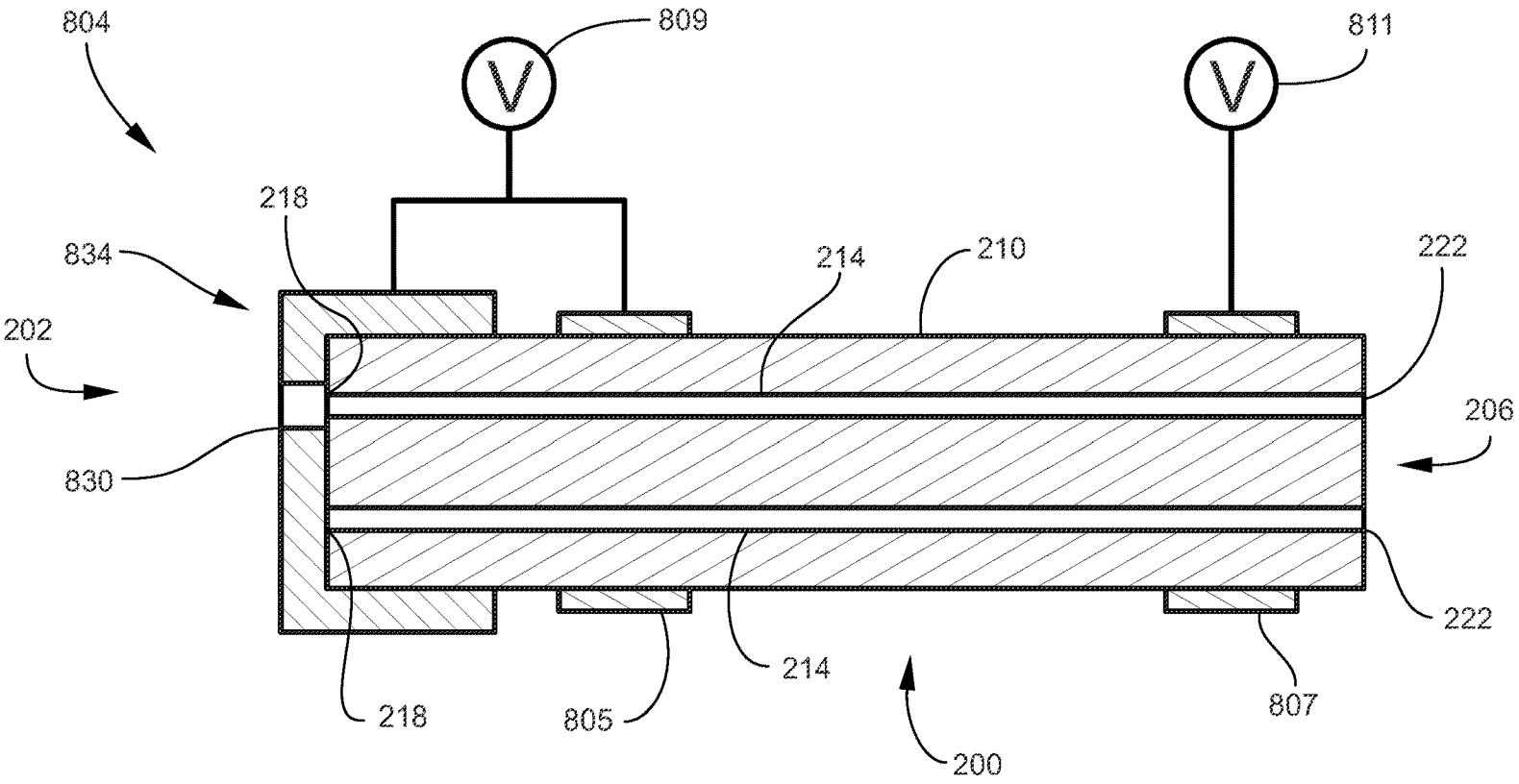
FIG. 8 is a cross-sectional side (lengthwise) view of an example of an ion transfer device according to another embodiment of the present disclosure.

FIG. 8 is a cross-sectional side (lengthwise) view of an example of an ion transfer device (or ion transfer device assembly) 804 according to another embodiment. The ion transfer device 804 includes the ion transfer tube 200 and an ion transfer bore selector 834 with one or more inlet ports 830 as described herein. The tube 200 and/or the bore selector 834 is movable to enable selection of one of the ion transfer tube bores 214 (or a group of tube bores 214) for active operation as described herein. In the present embodiment, the ion transfer device 804 further includes a first conductive or resistive element 805 disposed in or on the tube 200 at (or proximate to) the inlet end 202, and/or a second conductive or resistive element 807 disposed in or on the tube 200 at (or proximate to) the outlet end 206. The first conductive or resistive element 805 and the second conductive or resistive element 807 may be placed in electrical communication with appropriate electrical circuitry configured to apply (typically electrostatic) potentials to the first conductive or resistive element 805 and the second conductive or resistive element 807. The electrical circuitry is schematically depicted as a first voltage source 809 applying a first electrical potential to the first conductive or resistive element 805, and a second voltage source 811 applying a second electrical potential to the second conductive or resistive element 807.

In an embodiment, a relatively high voltage potential may be applied to the first conductive or resistive element 805 and a relatively low voltage potential may be applied to the second conductive or resistive element 807 to generate an axial potential difference across the length of the tube 200. The axial potential difference may aid in the transport of ions through the ion transfer device 804. In an embodiment, the relatively high voltage potential may be applied to the bore selector 834 as an alternative or in addition to applying the voltage potential to the first conductive or resistive element 805. In the illustrated embodiment, for example, the first conductive or resistive element 805 may be electrically interconnected with the bore selector 834 whereby the first conductive or resistive element 805 and the bore selector 834 may be held at the same potential. Alternatively, an electrical interconnecting component positioned between the tube 200 and the bore selector 834, such as the electrically conductive component 703 described above and illustrated in FIG. 7, may be provided for the same purpose. As another alternative, separate voltage sources may separately apply different voltage potentials to the first conductive or resistive element 805 and the bore selector 834. In this latter case, the bore selector 834 may be electrically isolated from the tube 200, such as by providing an electrically insulating layer or coating (e.g., on the inside surface of the bore selector 834 or the outside surface of the tube 200) between the bore selector 834 and the tube 200. In all cases, the potential on the bore selector 834 and/or the tube 200 at the inlet end 202 may be utilized to attract ions into the inlet port 830 and active tube bore(s) 214.

FIG. 9 is an end view of an example of an ion transfer device 904 according to another embodiment of the present disclosure. The ion transfer device 904 may be configured for use in an ion transfer system 102 or MS system 100 as described above, and thus may correspond to the ion transfer device 104 described above and illustrated in FIG. 1.

In an embodiment, the ion transfer device 904 is similar to the ion transfer device 304 described above and illustrated in FIGS. 3A-3C. Accordingly, the ion transfer device 904 may include a multi-bore ion transfer tube, such as the ion transfer tube 200 described above and illustrated in FIGS. 2A and 2B, which includes a plurality of tube bores 214. In FIG. 9, the tube bores 214 (FIGS. 2B and 3B) are individually designated 1-6, respectively, in the same manner as shown in FIGS. 2B and 3C. As in other embodiments of the present disclosure, the ion transfer tube 200 may include less or more than six tube bores 214.

In the present embodiment, the plurality of tube bores 214 are (at least conceptually or functionally) divided or defined into groups (or sets) of tube bores 214. Typically, each group of tube bores 214 contains the same number of tube bores 214. The number of tube bores 214 contained in or assigned to each bore group may depend on several factors such as, for example, the total number of tube bores 214 provided by the ion transfer tube 200, the sizes (e.g. diameter) of the tube bores 214, etc. Such factors may take into consideration, for example, the desired gas flow rate, total gas flow, and ion flow through the active ion transfer paths of the ion transfer device 904 during operation, as appreciated by persons skilled in the art. The tube bores 214 constituting a given bore group may be adjacent to each other, or may be separated from each other by intervening tube bores 214 that are part of a different bore group or groups.

As one example and as illustrated in FIG. 9, each bore group is defined as including two adjacent tube bores 214. Specifically in the case of a total number of six tube bores 214, three bore groups are defined, namely: a first bore group containing tube bores 1 and 2, a second bore group containing tube bores 3 and 4, and a third bore group containing tube bores 5 and 6.

In addition to the multi-bore ion transfer tube 200, the ion transfer device 904 may include an ion transfer bore selector 934 configured to enable selection of one group (or set) of the tube bores 214 of the ion transfer tube 200 for active operation while maintaining the other groups of tube bores 214 in a non-active state. In this manner, the ion transfer bore selector 934 is configured to enable selection of which group of tube bores 214 establishes the ion transfer paths through the ion transfer device 904, while simultaneously blocking ion and fluid flow through the other, non-selected groups of tube bores 214, at any given time during the operation of the ion transfer device 904 in the associated ion transfer system 102 or MS system 100, as described elsewhere in the present disclosure. For this purpose, the transfer bore selector 934 may include an inlet port. The inlet port may include one or more distinct inlet ports. The number of distinct inlet ports provided may depend on how the groups of tube bores 214 are defined.

In the illustrated embodiment, where each bore group is defined as including two adjacent tube bores 214, two distinct, adjacent inlet ports 930A and 930B are provided. FIG. 9 specifically illustrates a position at which the first bore group, tube bores 1 and 2, are selected for active operation by placing tube bores 1 and 2 in alignment (open communication) with the inlet ports 930A and 930B, respectively. At this position, the tube bores 214 of the other, non-selected bore groups (the second group of tube bores 3 and 4, and the third group of tube bores 5 and 6) are blocked by the ion transfer bore selector 934 and thus are non-active. After the tube bores 1 and 2 have become contaminated, the ion transfer device 904 may be switched to another position at which the second bore group is active and the first and third bore groups are inactive (blocked). After the tube bores 3 and 4 have become contaminated, the ion transfer device 904 may be switched to another position at which the third bore group is active and the first and second bore groups are inactive (blocked).

In the illustrated embodiment, the number of inlet ports 930A and 930B correspond to the number of tube bores 214 that constitute a single group from the total number of tube bores 214 provided by the ion transfer tube 200. In another embodiment, however, a single inlet bore may be configured (i.e., positioned, sized and shaped) to be aligned with all the tube bores 214 of a selected bore group. For example, a single curved or arcuate slot (not shown) spanning the bore inlets 218 of tube bores 1 and 2 (and subsequently tube bores 3 and 4 and tube bores 5 and 6), may be substituted for the two illustrated inlet ports 930A and 930B.

In another embodiment, the tube bores 214 of each bore group may not be adjacent to each other. For example, in the embodiment illustrated in FIG. 9, the bore groups may be defined as: tube bores 1 and 3, tube bores 2 and 4, and tube bores 3 and 6. In this case, the inlet ports 930A and 930B would be spaced from each other so as to be selectively alignable with the first bore group (tube bores 1 and 3), the second bore group (tube bores 2 and 4), and the third bore group (tube bores 3 and 6).

In another embodiment, two bore groups are defined, such as a first group consisting of tube bores 1, 2, and 3 and a second group consisting of tube bores 4, 5 and 6, or a first group consisting of tube bores 1, 3, and 5 and a second group consisting of tube bores 2, 4, and 6. Additional bore groups and combinations of tube bores assigned to each group are possible by providing a greater total number of tube bores in the ion transfer tube 200.

In another embodiment, some of the tube bores 214 of a given bore group may be adjacent to each other while other tube bores 214 of the same bore group are separated by intervening tube bores 214 that are part of one or more different groups. As one example, an ion transfer tube (not shown) may include twelve tube bores 1-12 arranged in a circular pattern similar to that shown in FIG. 9. Three bore groups may be defined as follows. A first bore group contains tube bores 1, 2, 7, and 8, where tube bores 1 and 2 are adjacent to each other, tube bores 7 and 8 are adjacent to each other, and tube bores 1 and 2 are separated from tube bores 7 and 8 by the other tube bores that are members of different bore groups. A second bore group contains tube bores 3, 4, 9, and 10, where tube bores 3 and 4 are adjacent to each other, tube bores 9 and 10 are adjacent to each other, and tube bores 3 and 4 are separated from tube bores 9 and 10 by the other tube bores that are members of different bore groups. A third bore group contains tube bores 5, 6, 11, and 12, where tube bores 5 and 6 are adjacent to each other, tube bores 11 and 12 are adjacent to each other, and tube bores 5 and 6 are separated from tube bores 11 and 12 by the other tube bores that are members of different bore groups. To enable selection of any of these bore groups, four distinct inlet ports may be provided for alignment with the respective four tube bores of the selected bore group (e.g., tube bores 1, 2, 7, and 8 of the first group). Alternatively, two distinct inlet ports in the form of curved slots may be provided for alignment with the respective pairs of adjacent tube bores of the selected bore group (e.g., tube bores 1 and 2 and tube bores 7 and 8 of the first group).

The ion transfer bore selector 934 may be configured according to any of the embodiments described herein. Thus, the ion transfer bore selector 934 may include a cover or end wall 938 positioned at the end face of the ion transfer tube 200. The inlet ports 930A and 930B may be formed through the axial thickness of the end wall 938. The end wall 938 is positioned, shaped, and sized such that it covers the bore inlets 218 of the tube bores 214 except for the tube bores 214 of the bore group selected for active operation (when the bore inlets 218 of the selected bore group are aligned with the inlet ports 930A and 930B). The end wall 938 may be part of an end cap or inlet cap enclosing the ion transfer tube 200 at least at the inlet end 202 as described herein.

The selection of one of the bore groups for active operation may be effected by any type of manual, powered, or automated movement (e.g., rotation about a device axis L, or linear translation) described herein. For example, the ion transfer tube 200 may be rotated about the device axis L relative to the ion transfer bore selector 934, and/or the ion transfer bore selector 334 may be rotated about the device axis L relative to the ion transfer tube 200, clockwise or counterclockwise as indicated by an arrow 950.

FIG. 10 is an end view of an example of an ion transfer device 1004 according to another embodiment of the present disclosure. The ion transfer device 1004 is similar to the ion transfer device 904 described above and illustrated in FIG. 9. Accordingly, the ion transfer device 1004 may include a multi-bore ion transfer tube 200 including a plurality of tube bores 214, and an ion transfer bore selector 1034 including a plurality of inlet ports (two inlet ports 1030A and 1030B in the illustrated example). In FIG. 10, the tube bores 214 (FIGS. 2B and 3B) are individually designated 1-6, respectively, in the same manner as shown in FIG. 9. As in other embodiments of the present disclosure, the ion transfer tube 200 may include less or more than six tube bores 214. The inlet ports 1030A and 1030B may be part of a cover such as an end wall 1038 as described herein.

In the present embodiment, the plurality of tube bores 214 are divided or defined into three groups (or sets) of tube bores 214: a first bore group containing tube bores 1 and 4, a second bore group containing tube bores 2 and 5, and a third bore group containing tube bores 3 and 6. Hence in this embodiment, the tube bores 214 of each bore group are separated from each other by intervening tube bores 214 that are part of different bore groups.

The inlet ports 1030A and 1030B are positioned so as to be selectively alignable with the respective tube bores 214 of each bore group. FIG. 10 shows the inlet ports 1030A and 1030B aligned with the first bore group, bores 1 and 4. As in other embodiments, the tube bores 214 and/or the inlet ports 1030A and 1030B may be moved in an indexed manner, such as by rotation as indicated by an arrow 1050, to select different bore groups for active operation. Thus, active operation of the ion transfer device 1004 may be switched from the first group (tube bores 1 and 4) to the second group (bores 2 and 5), and then to the third group (bores 3 and 6).

Figure 11:
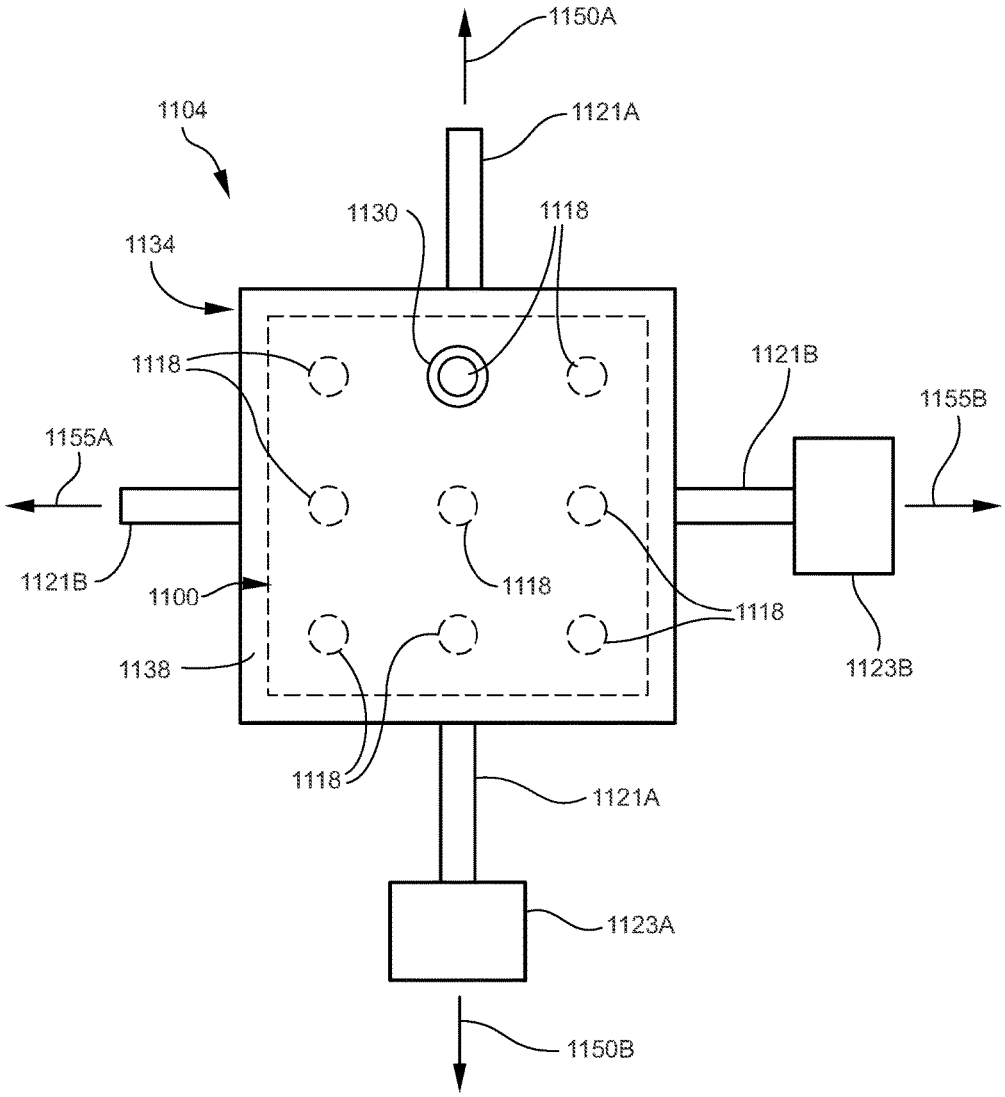
FIG. 11 is an end view of an example of an ion transfer device according to another embodiment of the present disclosure.

FIG. 11 is an end view of an example of an ion transfer device 1104 according to another embodiment of the present disclosure. The ion transfer device 1104 may be configured for use in an ion transfer system 102 or MS system 100 as described above, and thus may correspond to the ion transfer device 104 described above and illustrated in FIG. 1.

In an embodiment, the ion transfer device 1104 is similar to the ion transfer device 304 described above and illustrated in FIGS. 3A-3C. Accordingly, the ion transfer device 1104 may include a multi-bore ion transfer tube 1100 that is elongated as a cylinder along a device axis (in the direction of the drawing sheet) and includes multiple tube bores, as in the case of the ion transfer tube 200 described above and illustrated in FIGS. 2A and 2B. In the present embodiment, however, the tube bores, as indicated by their respective bore inlets 1118 in FIG. 11, are arranged in a two-dimensional or rectilinear array instead of a circular array. Nine tube bores (bore inlets 1118) are shown by example only. The ion transfer device 1104 may include less or more than nine tube bores.

As also shown in FIG. 11, the body of the ion transfer tube 1100 may have a rectilinear cross-section (in the plane of the drawing sheet, orthogonal to the elongated device axis), although in other embodiments may have a circular cross-section as in the case of the ion transfer tube 200 described above and illustrated in FIGS. 2A and 2B. The (body of the) ion transfer tube 1100 may have an outer dimension (in the illustrated cross-sectional plane) in a range from 0.5 mm to 20 mm outer diameter. In the case of a rectilinear cross-section (as illustrated), the outer dimension is the length of one side of the ion transfer tube 1100 (the vertical or horizontal side, from the perspective of FIG. 11), such as the longest side. In the case of a circular cross-section, the outer dimension is the outer diameter of the ion transfer tube 1100, as in other embodiments described herein.

In addition to the multi-bore ion transfer tube 1100, the ion transfer device 1104 further includes an ion transfer bore selector (or bore selector, or ion inlet structure) 1134. Generally, the ion transfer bore selector 1134 may be configured, and positioned in the ion transfer system 102 or MS system 100, as described herein. Thus, the ion transfer bore selector 1134 is configured to enable selection of one (or one group) of the tube bores of the ion transfer tube 1100 for active operation while maintaining the other tube bores in a non-active state. For this purpose, the ion transfer bore selector 1134 may include an inlet port 1130, or two or more inlet ports in a case where multiple tube bores are to be active at a given time. The inlet port(s) 1130 may be formed through the thickness of a cover or end wall 1138 of the ion transfer bore selector 1134. The end wall 1138 may be positioned adjacent to the end face of the ion transfer tube 1100 at which the bore inlets 1118 are located, as described herein. A tube bore is selected by placing that tube bore (i.e., its bore inlet 1118) in communication with the inlet port 1130 and thereby in communication with the first chamber 128 (FIG. 1) via the inlet port 1130. In the example shown in FIG. 11, one tube bore is aligned (and thus in open communication) with the inlet port 1130 and thus in an active state that establishes an ion transfer path through the ion transfer device 1104, while the other, non-selected tube bores are blocked by the end wall 338 and thus are in a non-active state at which flow into the non-selected bore inlets 1118 is prevented.

As in other embodiments, selecting one of the tube bores (or bore groups) for active operation entails moving the ion transfer tube 1100 relative to the ion transfer bore selector 1134, and/or moving the ion transfer bore selector 1134 relative to the ion transfer tube 1100. In the present embodiment in which a two-dimensional bore array is provided, the movement is by linear translation in a direction orthogonal to the device axis, namely in a direction 1150A or 1150B along a first axis and/or in a direction 1150B or 1155B along a second axis orthogonal to the first axis, as needed. For this purpose, the ion transfer device 1104 may include a support structure that includes support members 1121A and 1121B (e.g., linear bearings, etc.) coupled to the ion transfer tube 1100 and/or the ion transfer bore selector 1134 (depending on which is movable). The support member 1121A may have any configuration suitable to enable movement of the ion transfer tube 1100 and/or ion transfer bore selector 1134 along the first axis, and the other support member 1121B may have any configuration suitable to enable movement of the ion transfer tube 1100 and/or ion transfer bore selector 1134 along the second axis.

The support structure may be configured to enable manual movement or automated/motorized movement of the ion transfer tube 1100 and/or ion transfer bore selector 1134. In the case of automated/motorized movement, the ion transfer device 1104 may include, for example, stepper motors 1123A and 1123B for actuating movement along the first and second axes, respectively. In this case, the support members 1121A and 1121B may include appropriate transmission linkages (e.g., sets of racks and pinions, screws and worm gears, etc.) coupling the stepper motors 1123A and 1123B to the ion transfer tube 1100 and/or ion transfer bore selector 1134. More generally, the ion transfer device 1104 and its support structure may have any configuration suitable for providing X-Y movement to selectively align the inlet port 1130 with the tube bore inlets 1118, as appreciated by persons skilled in the art.

In another embodiment, the ion transfer tube 1100 includes a one-dimensional (linear) array of tube bores, i.e. a single row or column of tube bores in comparison to the two-dimensional array specifically shown in FIG. 11. In such case, the ion transfer device 1104 is configured to move (or enable movement of) the ion transfer tube 1100 and/or the ion transfer bore selector 1134 along a single axis (e.g., X or Y) along which the tube bores are arranged.

Other embodiments of an ion transfer device encompassed by the present disclosure may include different combinations of the various features described herein, including features illustrated in FIGS. 2A-11.

Exemplary Embodiments

Exemplary embodiments provided in accordance with the presently disclosed subject matter include, but are not limited to, the following:

1. An ion transfer device for transferring ions from a first chamber to a second chamber, the ion transfer device comprising: a tube comprising an inlet end, an outlet end, a body elongated along a device axis from the inlet end to the outlet end, and a plurality of tube bores extending through the body from the inlet end to the outlet end, the tube bores being spaced from each other wherein the tube bores comprise respective bore inlets at the inlet end and respective bore outlets at the outlet end; and a bore selector positioned at the inlet end and comprising an inlet port, wherein at least one of the tube or the bore selector is movable to align the inlet port with the bore inlet of a selected tube bore of the plurality of tube bores while blocking at least one of the bore inlets of the other tube bores, and alignment of the inlet port with the bore inlet of the selected tube bore defines an ion transfer path through the inlet port and the selected tube bore.

2. The ion transfer device of embodiment 1, wherein each tube bore has a bore length along the device axis from the bore inlet to the bore outlet, and the bore length is in a range from 30 mm to 200 mm.

3. The ion transfer device of any of the preceding embodiments, wherein each tube bore has an inside diameter in a range from 0.1 mm to 1 mm.

4. The ion transfer device of any of the preceding embodiments, wherein the tube has an outer diameter in a range from 0.5 mm to 20 mm.

5. The ion transfer device of any of the preceding embodiments, wherein the inlet bore has an inside diameter in a range from 0.05 mm to 3 mm.

6. The ion transfer device of any of the preceding embodiments, wherein each tube bore has a bore inside diameter, and the inlet bore has an inlet bore inside diameter equal to the bore inside diameter.

7. The ion transfer device of any of embodiments 1-5, wherein each tube bore has a bore inside diameter, and the inlet bore has an inlet bore inside diameter greater than the bore inside diameter.

8. The ion transfer device of any of embodiments 1-5, wherein each tube bore has a bore inside diameter, and the inlet bore has an inlet bore inside diameter less than the bore inside diameter.

9. The ion transfer device of any of the preceding embodiments, wherein the tube has a composition selected from the group consisting of: an electrically conductive material; an electrically insulating material; an electrically insulating material with bulk electrical resistance; and an electrically insulating material with surface electrical resistance.

10. The ion transfer device of any of the preceding embodiments, wherein the bore selector has a composition selected from the group consisting of: an electrically conductive material; an electrically insulating material; an electrically insulating material with bulk electrical resistance; and an electrically insulating material with surface electrical resistance.

11. The ion transfer device of any of the preceding embodiments, wherein the bore selector is electrically interconnected with the tube.

12. The ion transfer device of any of embodiments 1-10, wherein the bore selector is electrically isolated from the tube.

13. The ion transfer device of any of the preceding embodiments, wherein the bore selector comprises a cover defining the inlet port.

14. The ion transfer device of any of the preceding embodiments, wherein the bore selector comprises an inlet cap enclosing the tube at least at the inlet end.

15. The ion transfer device of embodiment 14, wherein the inlet cap comprises a cavity and the tube extends into the cavity.

16. The ion transfer device of any of the preceding embodiments, wherein at least one of the tube or the bore selector is movable according to a movement selected from the group consisting of: rotation about the device axis; and linear translation in a direction orthogonal to the device axis.

17. The ion transfer device of any of the preceding embodiments, comprising a support structure contacting at least one of the tube or the bore selector, wherein the support structure is configured allow movement of at least one of the tube or the bore selector to align the inlet port with the bore inlet of the selected tube bore.

18. The ion transfer device of embodiment 17, wherein the support structure is configured to constrain movement of at least one of the tube or the bore selector along the device axis and along radial directions orthogonal to the device axis.

19. The ion transfer device of embodiment 17 or 18, wherein the support structure comprises a support structure opening surrounding the tube or both the tube and the bore selector.

20. The ion transfer device of embodiment 19, comprising a sealing member disposed in the support structure opening and surrounding the tube or both the tube and the bore selector, wherein the sealing member is configured to limit conductance of gas through the support structure opening between the support structure and the tube or the bore selector.

21. The ion transfer device of any of embodiments 17-20, wherein the support structure comprises a front support structure contacting at least one of the tube or the bore selector at or proximate to the inlet end, and a rear support structure contacting the tube at or proximate to the outlet end.

22. The ion transfer device of any of the preceding embodiments, wherein the plurality of tube bores comprises a plurality of groups of tube bores, the inlet bore is configured to align with the bore inlets of a selected group of the plurality of groups while blocking the bore inlets of the other groups, and at least one of the tube or the bore selector is movable to align the inlet port with the bore inlets of the selected group, and alignment of the inlet port with the bore inlets of the selected group defines an ion transfer path through the inlet port and the tube bores of the selected group.

23. The ion transfer device of embodiment 22, wherein the inlet port comprises a plurality of inlet ports configured to respectively align with the bore inlets of the selected group.

24. An ion transfer system, comprising: the ion transfer device of any of the preceding embodiments; a first chamber; a second chamber configured to be evacuated down to a pressure lower than a pressure of the first chamber; and a wall separating the first chamber and the second chamber, the wall having a thickness and comprising an opening extending through the thickness, wherein the ion transfer device is positioned at the wall, at least one of the tube or both the tube and the bore selector extend into the opening, the inlet port communicates with the first chamber, and the bore outlets communicate with the second chamber.

25. The ion transfer system of embodiment 24, wherein the second chamber comprises a vacuum port configured for communication with a vacuum pump.

26. The ion transfer system of embodiment 24 or 25, comprising a support structure communicating with at least one of the tube or the bore selector, wherein the support structure is configured allow movement of at least one of the tube or the bore selector to align the inlet port with the bore inlet of the selected tube bore.

27. The ion transfer system of embodiment 26, wherein the support structure is configured to constrain movement of at least one of the tube or the bore selector along the device axis and along radial directions orthogonal to the device axis.

28. The ion transfer system of embodiment 26 or 27, wherein the support structure is disposed in the first chamber.

29. The ion transfer system of any of embodiments 26-28, wherein the support structure is part of or mounted to the wall.

30. The ion transfer system of any of embodiments 26-29, wherein the support structure is disposed in the second chamber.

31. A mass spectrometry (MS) system, comprising: the ion transfer system of any of embodiments 24-30; an atmospheric-pressure ionization device configured for producing ions in the first chamber; a vacuum housing enclosing the second chamber; and a mass analyzer disposed in the vacuum housing.

32. A method for transferring ions, the method comprising: creating a pressure differential between a first chamber and a second chamber such that the second chamber has a pressure less than a pressure of the first chamber, wherein: the first chamber and the second chamber are separated by a wall; and an ion transfer device extends through the wall and comprises a tube, the tube comprising a plurality of tube bores, the tube bores comprising respective bore inlets and bore outlets; placing a selected tube bore of the plurality of tube bores in communication with the first chamber while preventing communication between at least one of the other tube bores and the first chamber; producing ions in the first chamber; and drawing the ions into the selected tube bore, and transporting the ions through the selected tube bore and into the second chamber.

33. The method of embodiment 32, wherein the placing comprises moving the tube until the selected tube bore communicates with the first chamber.

34. The method of embodiment 33, wherein the ion transfer device comprises a bore selector positioned at an inlet end of the tube, the bore selector comprising an inlet port communicating with the first chamber, and the placing comprises moving the tube relative to the bore selector until the selected tube bore communicates with the inlet port.

35. The method of embodiment 32, wherein the ion transfer device comprises a bore selector positioned at an inlet end of the tube, the bore selector comprising an inlet port communicating with the first chamber, and the placing comprises moving the bore selector relative to the tube until the selected tube bore communicates with the inlet port.

36. The method of any of embodiments 32-35, wherein the selected tube bore is a first selected tube bore, and further comprising, after the transporting, placing a second selected tube bore of the plurality of tube bores in communication with the first chamber while preventing communication between at least one of the other tube bores and the first chamber, the at least one of the other tube bores including the first selected tube bore.

37. The method of any of embodiments 32-36, wherein the plurality of tube bores comprises a plurality of groups of tube bores, and the placing comprises placing a selected group of the plurality of groups in communication with the first chamber while preventing communication between the other groups and the first chamber.

38. A method for transferring ions, the method comprising: creating a pressure differential between a first chamber and a second chamber such that the second chamber has a pressure less than a pressure of the first chamber, wherein the first chamber and the second chamber are separated by a wall, and the ion transfer device of any of embodiments 1-23 extends through the wall; producing ions in the first chamber; drawing the ions into the bore inlet of the selected tube bore while the bore inlet is aligned with the inlet port; transporting the ions through the selected tube bore; and emitting the ions from the bore outlet of the selected tube bore and into the second chamber.

39. The method of embodiment 38, comprising, before the drawing, aligning the bore inlet of the selected tube bore with the inlet port by moving at least one of the tube or the bore selector.

40. The method of embodiment 38, wherein the plurality of tube bores comprises a plurality of groups of tube bores, and comprising, before the drawing, aligning the bore inlets of a selected one of the groups with the inlet port by moving at least one of the tube or the bore selector, and wherein: the drawing comprises the ions into the bore inlets of the tube bores of the selected group while the bore inlets are aligned with the inlet port; the transporting comprises transporting the ions through the tube bores of the selected group; and the emitting comprises emitting the ions from the bore outlets of the tube bores of the selected group.

It will be understood that terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion transfer device for transferring ions from a first chamber to a second chamber, the ion transfer device comprising:

a tube comprising an inlet end, an outlet end, a body elongated along a device axis from the inlet end to the outlet end, and a plurality of tube bores extending through the body from the inlet end to the outlet end, the tube bores being spaced from each other wherein the tube bores comprise respective bore inlets at the inlet end and respective bore outlets at the outlet end; and a bore selector positioned at the inlet end and comprising an inlet port, wherein at least one of the tube or the bore selector is movable to align the inlet port with the bore inlet of a selected tube bore of the plurality of tube bores while blocking at least one of the bore inlets of the other tube bores, and alignment of the inlet port with the bore inlet of the selected tube bore defines an ion transfer path through the inlet port and the selected tube bore.

2. The ion transfer device of claim 1, wherein the bore selector is electrically interconnected with the tube.

3. The ion transfer device of claim 1, wherein the bore selector is electrically isolated from the tube.

4. The ion transfer device of claim 1, wherein the bore selector comprises a cover defining the inlet port.

5. The ion transfer device of claim 1, wherein the bore selector comprises an inlet cap enclosing the tube at least at the inlet end.

6. The ion transfer device of claim 5, wherein the inlet cap comprises a cavity and the tube extends into the cavity.

7. The ion transfer device of claim 1, wherein at least one of the tube or the bore selector is movable according to a movement selected from the group consisting of: rotation about the device axis; and linear translation in a direction orthogonal to the device axis.

8. The ion transfer device of claim 1, comprising a support structure contacting at least one of the tube or the bore selector, wherein the support structure is configured allow movement of at least one of the tube or the bore selector to align the inlet port with the bore inlet of the selected tube bore.

9. The ion transfer device of claim 8, wherein the support structure is configured to constrain movement of at least one of the tube or the bore selector along the device axis and along radial directions orthogonal to the device axis.

10. The ion transfer device of claim 8, wherein the support structure comprises a support structure opening surrounding the tube or both the tube and the bore selector.

11. The ion transfer device of claim 10, comprising a sealing member disposed in the support structure opening and surrounding the tube or both the tube and the bore selector, wherein the sealing member is configured to limit conductance of gas through the support structure opening between the support structure and the tube or the bore selector.

12. The ion transfer device of claim 8, wherein the support structure comprises a front support structure contacting at least one of the tube or the bore selector at or proximate to the inlet end, and a rear support structure contacting the tube at or proximate to the outlet end.

13. The ion transfer device of claim 1, wherein the plurality of tube bores comprises a plurality of groups of tube bores, the inlet bore is configured to align with the bore inlets of a selected group of the plurality of groups while blocking the bore inlets of the other groups, and at least one of the tube or the bore selector is movable to align the inlet port with the bore inlets of the selected group, and alignment of the inlet port with the bore inlets of the selected group defines an ion transfer path through the inlet port and the tube bores of the selected group.

14. The ion transfer device of claim 13, wherein the inlet port comprises a plurality of inlet ports configured to respectively align with the bore inlets of the selected group.

15. An ion transfer system, comprising:

the ion transfer device of claim 1;

a first chamber;

a second chamber configured to be evacuated down to a pressure lower than a pressure of the first chamber; and a wall separating the first chamber and the second chamber, the wall having a thickness and comprising an opening extending through the thickness, wherein the ion transfer device is positioned at the wall, at least one of the tube or both the tube and the bore selector extend into the opening, the inlet port communicates with the first chamber, and the bore outlets communicate with the second chamber.

16. A mass spectrometry (MS) system, comprising:

the ion transfer system of claim 15;

an atmospheric-pressure ionization device configured for producing ions in the first chamber;

a vacuum housing enclosing the second chamber; and a mass analyzer disposed in the vacuum housing.

17. A method for transferring ions, the method comprising:

creating a pressure differential between a first chamber and a second chamber such that the second chamber has a pressure less than a pressure of the first chamber, wherein:

the first chamber and the second chamber are separated by a wall; and an ion transfer device extends through the wall and comprises a tube, the tube comprising a plurality of tube bores, the tube bores comprising respective bore inlets and bore outlets;

placing a selected tube bore of the plurality of tube bores in communication with the first chamber while preventing communication between at least one of the other tube bores and the first chamber;

producing ions in the first chamber; and drawing the ions into the selected tube bore, and transporting the ions through the selected tube bore and into the second chamber.

18. The method of claim 17, wherein the placing is selected from the group consisting of:

the placing comprises moving the tube until the selected tube bore communicates with the first chamber;

wherein the ion transfer device comprises a bore selector positioned at an inlet end of the tube, the bore selector comprising an inlet port communicating with the first chamber, and the placing comprises moving the tube relative to the bore selector until the selected tube bore communicates with the inlet port; and wherein the ion transfer device comprises a bore selector positioned at an inlet end of the tube, the bore selector comprising an inlet port communicating with the first chamber, and the placing comprises moving the bore selector relative to the tube until the selected tube bore communicates with the inlet port.

19. The method of claim 17, wherein the selected tube bore is a first selected tube bore, and further comprising, after the transporting, placing a second selected tube bore of the plurality of tube bores in communication with the first chamber while preventing communication between at least one of the other tube bores and the first chamber, the at least one of the other tube bores including the first selected tube bore.

20. A method for transferring ions, the method comprising:

creating a pressure differential between a first chamber and a second chamber such that the second chamber has a pressure less than a pressure of the first chamber, wherein the first chamber and the second chamber are separated by a wall, and the ion transfer device of claim 1 extends through the wall;

producing ions in the first chamber;

drawing the ions into the bore inlet of the selected tube bore while the bore inlet is aligned with the inlet port;

transporting the ions through the selected tube bore; and emitting the ions from the bore outlet of the selected tube bore and into the second chamber.

* * * * *